US009474386B2

(12) United States Patent
Scarleski

(10) Patent No.: US 9,474,386 B2
(45) Date of Patent: Oct. 25, 2016

(54) ADJUSTABLE MATTRESS RETAINER BARS

(71) Applicant: Levitation Sciences LLC, Chicago, IL (US)

(72) Inventor: William John Scarleski, Chicago, IL (US)

(73) Assignee: LEVITATION SCIENCES LLC, Chicago, IL (US)

( * ) Notice: Subject to any disclaimer, the term of this patent is extended or adjusted under 35 U.S.C. 154(b) by 0 days.

(21) Appl. No.: 14/628,765

(22) Filed: Feb. 23, 2015

(65) Prior Publication Data

US 2015/0366362 A1 Dec. 24, 2015

Related U.S. Application Data

(63) Continuation-in-part of application No. 14/304,385, filed on Jun. 13, 2014.

(51) Int. Cl.
*A47C 21/00* (2006.01)
*A47C 21/02* (2006.01)

(52) U.S. Cl.
CPC ..... *A47C 21/026* (2013.01)

(58) Field of Classification Search
CPC ..... A47C 21/00
USPC ..... 5/658, 659, 411, 193, 503.1
See application file for complete search history.

(56) References Cited

U.S. PATENT DOCUMENTS

| | | | | |
|---|---|---|---|---|
| 2,669,732 | A | 2/1954 | Moon | |
| 2,817,854 | A | 12/1957 | Pratt | |
| 3,002,200 | A | 10/1961 | Murcott | |
| 3,032,781 | A | 5/1962 | Constanti | |
| 4,439,880 | A | 4/1984 | Koncelik et al. | |
| 6,240,583 | B1 * | 6/2001 | Brooke | A61G 7/012 5/430 |
| 7,805,789 | B1 * | 10/2010 | Dean | A47C 21/08 5/646 |

* cited by examiner

*Primary Examiner* — Fredrick Conley
(74) *Attorney, Agent, or Firm* — John S. Paniaguas; Clark Hill PLC

(57) ABSTRACT

A. mattress bar retainer system is disclosed for use with adjustable mattress platforms. The mattress retainer bar system is used to prevent movement of the mattress during positioning of the adjustable mattress platform assembly. In a rotate mode of operation, one or more mattress retainer bars at the head/foot end or corners of the bed are removably attachable and re-installable to the mattress platform. In an alternate embodiment, the mattress retainer bars are configured to be positioned to enable the mattress to be rotated relative to the adjustable mattress platform in a rotate mode of operation. After the mattress is rotated to the desired position, the mattress retainer bars are restored to their normal position in a normal mode of operation. In an alternative embodiment, the retainer bars are motorized to enable the retainer bars to be positioned at the touch of a button on a control pad. In an alternate embodiment of the invention, a retainer bar is disclosed for use with fitted sheets. In yet another embodiment, the retainer bar is secured to the mattress platform and received in a pocket in an underside of a mattress encasement.

20 Claims, 21 Drawing Sheets

ENCASEMENT
HORIZONTAL RETAINER BAR
432
430
434
UNDERSIDE POCKET

HORIZONTAL RETAINER BAR
432
434
436
FOUNDATION

ENCASEMENT
440
438
430
54
FOUNDATION WORKS WITH ADJUSTABLE FOUNDATION ONLY
HORIZONTAL RETAINER BAR
436

ADJUSTABLE MATTRESS RETAINER BARS

CROSS REFERENCE TO RELATED APPLICATIONS

This application is a continuation-in-part of U.S. patent application Ser. No. 14/304,385, filed on Jun. 13, 2014.

BACKGROUND OF THE INVENTION

1. Field of the Invention

The present invention relates to mattress retainer bar system for retaining a mattress in place during positioning of an adjustable mattress platform assembly that includes one or more mattress retainer bars that are removably attached to the adjustable mattress platform assembly or can be positioned to enable the mattress to be rotated or slid off of the mattress platform assembly to install or launder or change a bed skirt or protective mattress encasement.

2. Description of the Prior Art

Conventional beds with adjustable platform assemblies are known for home use. An example of such a bed is disclosed in U.S. Pat. No. 7,810,194, hereby incorporated by reference. Such beds normally include a motorized adjustable mattress platform assembly and a mattress. The adjustable mattress platform assemblies allow the mattress to be contorted into various configurations. Some of those configurations can cause the mattress to move or slide out of position relative to the adjustable mattress platform assembly.

Such movement is highly undesirable. In order to prevent such movement, various methods have been developed to prevent movement of the mattress from moving as a result of positioning of the adjustable mattress platform assembly. In order to prevent such movement, various mattress retainer systems have been developed. Examples of such mattress retainer systems are disclosed in the following U.S. Pat. Nos. 6,684,425; and 7,810,194. Mattress retainer systems are also disclosed in the following US published applications: US 2010/0229309 A1 and US 2013/0185868 A1.

These mattress retainer systems fall into various categories. For example, some known mattress retainer systems are generally disposed at the head and/or foot end of the bed. Examples of this type of mattress retainer system are disclosed in U.S. Pat. Nos. 6,684,425; 7,353,550; and US Patent Application Publication No. US 2010/0229309 A1. Other known mattress retainer systems are used to restrain the corners of the mattress on the foot end of the bed. An example of this type of retainer system is disclosed in US Patent Application Publication No. US 2013/0185868 A1. Finally, other types of mattress retainer systems utilize fasteners to secure a mattress having a rigid substrate to an adjustable platform assembly. An example of this mattress retainer system is disclosed in U.S. Pat. No. 7,810,194.

Known mattress retainer systems can also be categorized by how they are disposed relative to the mattress and the platform. Several known systems rely on friction to retain the mattress retainer system in place.

One such system that relies on friction is disclosed in the '425 patent mentioned above. That system includes a mattress retainer bar disposed at one end of the bed that extends upwardly from the adjustable platform assembly. The retainer bar is connected to one or more frictional surfaces disposed between the underside of the mattress and the adjustable platform assembly. The combination of the retainer bar and the frictional surfaces are used to prevent the mattress from sliding toward the foot end of the bed when the head end of the mattress is lifted.

US Patent Application Publication No. US 2010 0229309 A1 is another type of mattress retainer system that relies on friction as well as clamping forces to hold the mattress retainer system in place between an adjustable platform assembly and a mattress. Specifically, the mattress retainer system includes a mattress retainer bar that is configured to be disposed so as to extend upwardly from adjustable platform assembly to retain the mattress in place. The mattress retainer bar is formed in a "C" shape defining a pair of spaced apart legs connected together at one end by a bight portion. A paper clip type arrangement is formed at the opposing end of the legs in a plane perpendicular to the plane of the mattress retainer bar. The paper clip arrangement is used to clip the mattress retainer bar to the adjustable platform assembly.

Both of the systems described above rely at least partially on friction to "secure" the mattress relative to the adjustable platform assembly. In particular, the mattress retainer system disclosed in '425 system relies totally on friction to secure the mattress retainer system relative to the bed. The '309 application relies on clamping forces as well as friction to secure the mattress retainer in place relative to the bed.

Such systems that rely on friction have a limited utility. In particular, such systems need to be designed to withstand the weight of the mattress as well as one or two occupants of the bed. In other words, the force of the weight will oppose the friction force.

Mattresses are relatively heavy items. The weight of a mattress varies as a function of the coil core, the gauge of the coil and the type of foam material used. An average king size mattress weighs between 85 and 115 pounds. High end king size mattresses with latex or memory foam can weigh as much as 300 pounds (mattressdirectonline.com). With two people on the bed, the force opposing the friction and the clamping forces could therefore be 600 pounds or more. Although the systems described above could likely provide satisfactory performance with older lighter weight mattresses, it would seemingly be impossible to provide a sufficient amount of friction to oppose a weight force with heavier mattresses when one end of the mattress is lifted, as discussed above.

As such, mattress retainer systems have been developed that are permanently secured to the adjustable platform assembly. Examples of such mattress retainer systems are disclosed in U.S. Pat. Nos. 7,353,550 and 7,810,194 as well as US Patent Application Publication No. 2013/0185868 A1. Although these mattress retainer systems solve the problem described above, such mattress retainer systems cause another problem.

In particular, a problem with these types of mattresses is that over time, the mattress materials lose their resiliency causing body depressions to develop. In order to even out the wear in the mattress, it is known to rotate the mattress in the horizontal plane to relocate the body depressions. In order to rotate a mattress with a permanently installed mattress retainer system, the mattress retainer system would have to be removed in order to rotate the mattress and re-installed after the mattress was rotated. Alternatively, the mattress could be lifted up high enough to clear the mattress retainer system; rotated and subsequently lowered into place. In order to rotate a mattress, the mattress must first be lifted and then rotated. Both methods are relatively cumbersome. Moreover, rotating a mattress is hard work. Depending on the weight of the mattress, rotating a mattress would be virtually impossible for some people, such as senior citizens, as well as people that are handicapped or disabled and others.

Thus there is a need for a mattress retainer system that can be securely attached to the adjustable platform assembly while facilitating rotation of a mattress.

SUMMARY OF THE INVENTION

Briefly, the invention relates to a. mattress bar retainer system for use with adjustable mattress platforms. The mattress retainer bar system is used to prevent movement of the mattress during positioning of the adjustable mattress platform assembly. In a rotate mode of operation, one or more mattress retainer bars at the head/foot end and/or corners of the bed are removably attachable and re-installable to the mattress platform. In an alternate embodiment, the mattress retainer bars are configured to be positioned to enable the mattress to be rotated relative to the adjustable mattress platform in a rotate mode of operation. After the mattress is rotated to the desired position, the mattress retainer bars are restored to their normal position in a normal mode of operation. In an alternative embodiment, the retainer bars are motorized to enable the retainer bars to be positioned at the touch of a button on a control pad. In another embodiment of the invention, a retainer bar is disclosed for use with fitted sheets. In yet another embodiment, the retainer bar is secured to the mattress platform and received in a pocket in an underside of a mattress encasement.

DESCRIPTION OF THE DRAWING

These and other advantages of the present invention will be readily understood with reference to the following specification and attached drawing wherein.

DETAILED DESCRIPTION

The invention relates to a. mattress bar retainer system for use with adjustable mattress platforms. The mattress retainer bar system is used to prevent movement of the mattress during positioning of the adjustable mattress platform assembly. In a rotate mode of operation, one or more mattress retainer bars at the head/foot end and/or corners of the bed are removably attachable and re-installable to the mattress platform. In an alternate embodiment, the mattress retainer bars are configured to be positioned to enable the mattress to be rotated relative to the adjustable mattress platform in a rotate mode of operation. After the mattress is rotated to the desired position, the mattress retainer bars are restored to their normal position in a normal mode of operation. In an alternative embodiment, the retainer bars are motorized to enable the retainer bars to be positioned at the touch of a button on a control pad. In an alternate embodiment of the invention, a retainer bar is disclosed for use with fitted sheets. In yet another embodiment, the retainer bar is secured to the mattress platform and received in a pocket in an underside of a mattress encasement.

Figure 10:
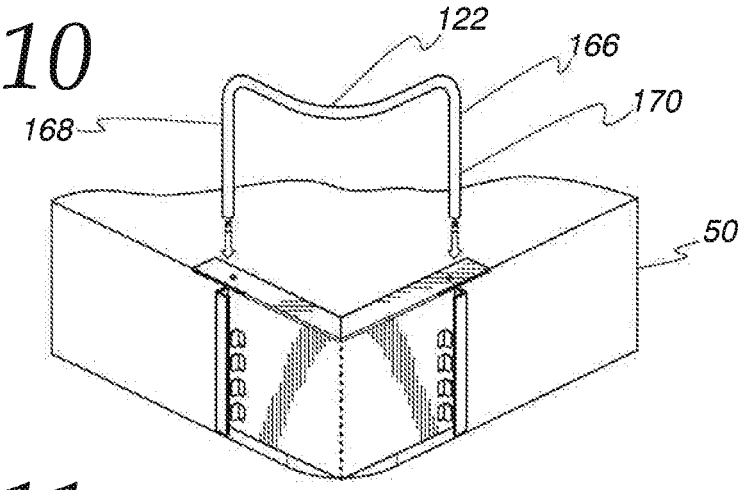
FIG. 10 is an isometric illustrating a section of the adjustable platform assembly and mattress with the bracket illustrated in FIG. 9 rigidly attached to one corner of the adjustable platform assembly, shown with a mattress retainer bar removed.
Figure 11:
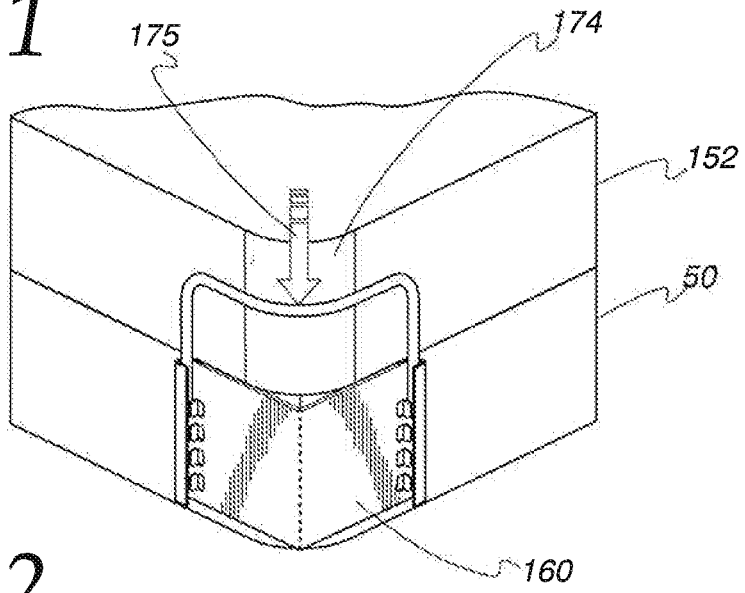
FIG. 11 is an isometric view of a portion of the adjustable platform assembly and mattress, shown with the bracket illustrated in FIG. 10 rigidly attached to one corner of the adjustable platform assembly and the mattress retainer bar partially installed in the bracket.
Figure 12:
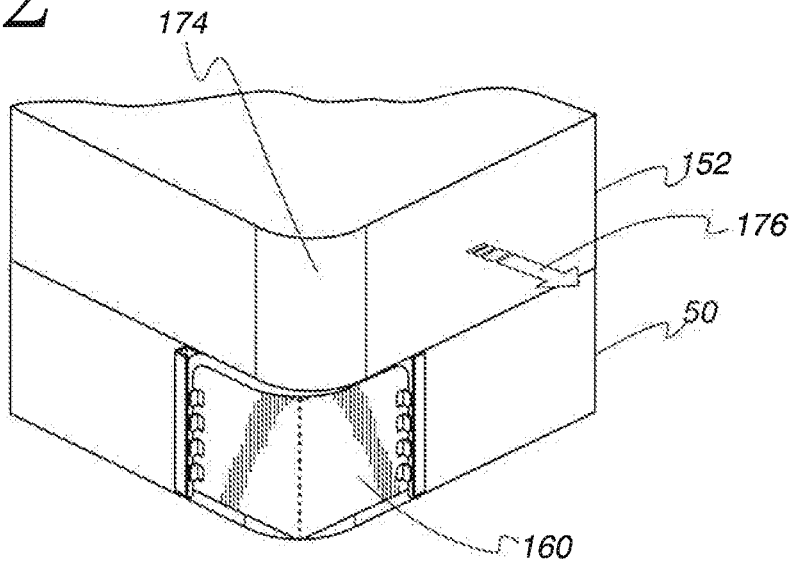
FIG. 12 is similar to FIG. 11 but shown with the mattress retainer bar in a fully retracted position and the mattress partially slid off the adjustable platform assembly.
Figure 13:
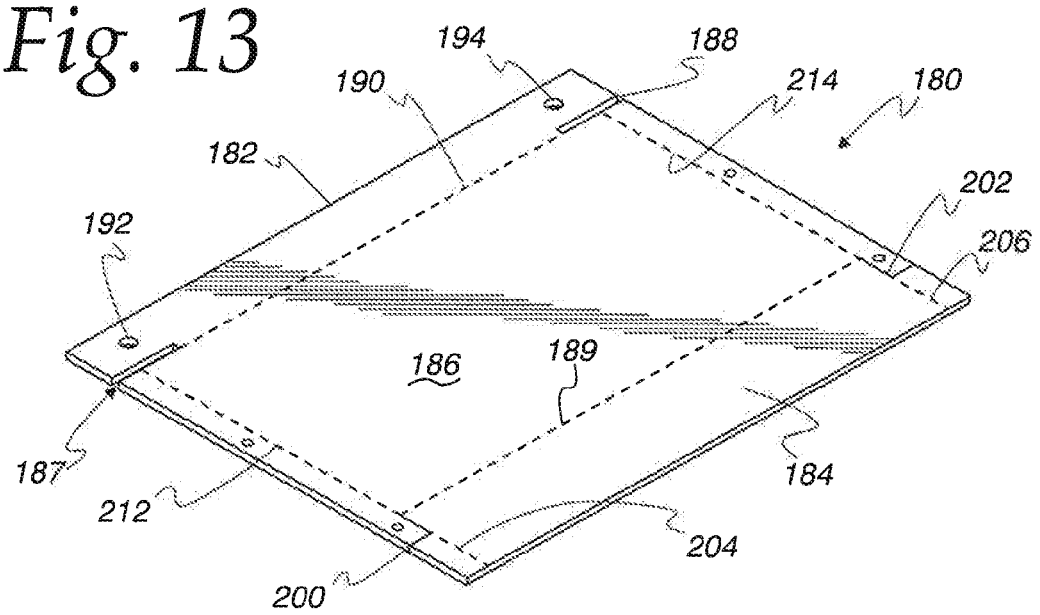
FIG. 13 is an isometric view of an un-formed bracket for use with an alternate embodiment of the invention.
Figure 17:
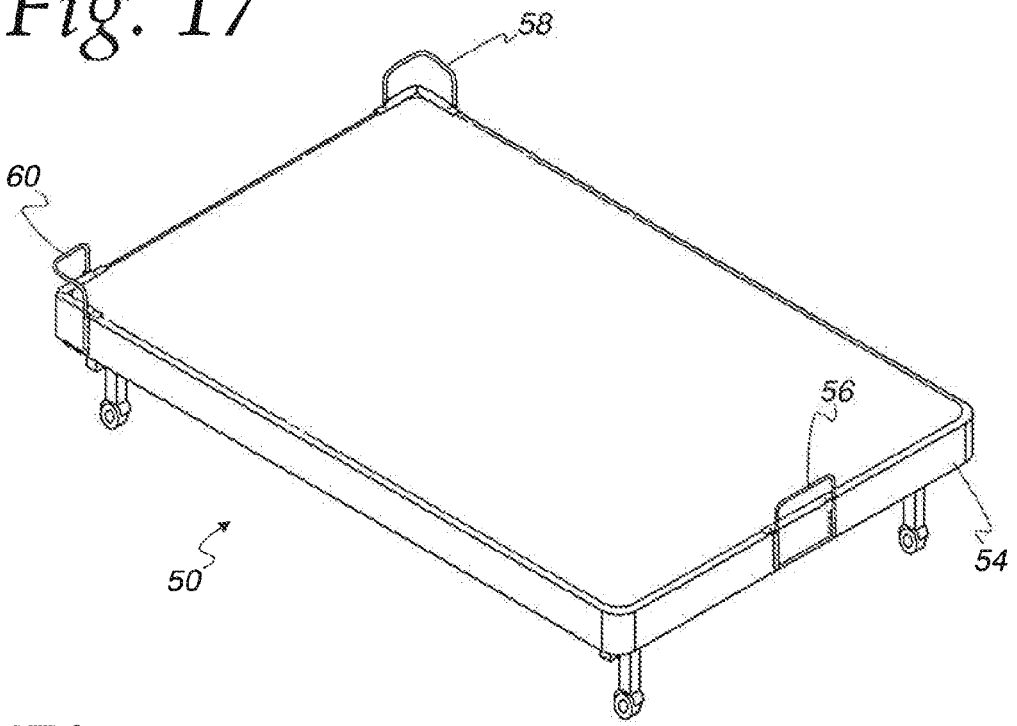
FIG. 17 is an isometric view of an adjustable platform assembly shown with mattress retainer bars in accordance with the present invention installed on two corners and one end of the adjustable platform assembly, all shown in an extended position.
Figure 18:
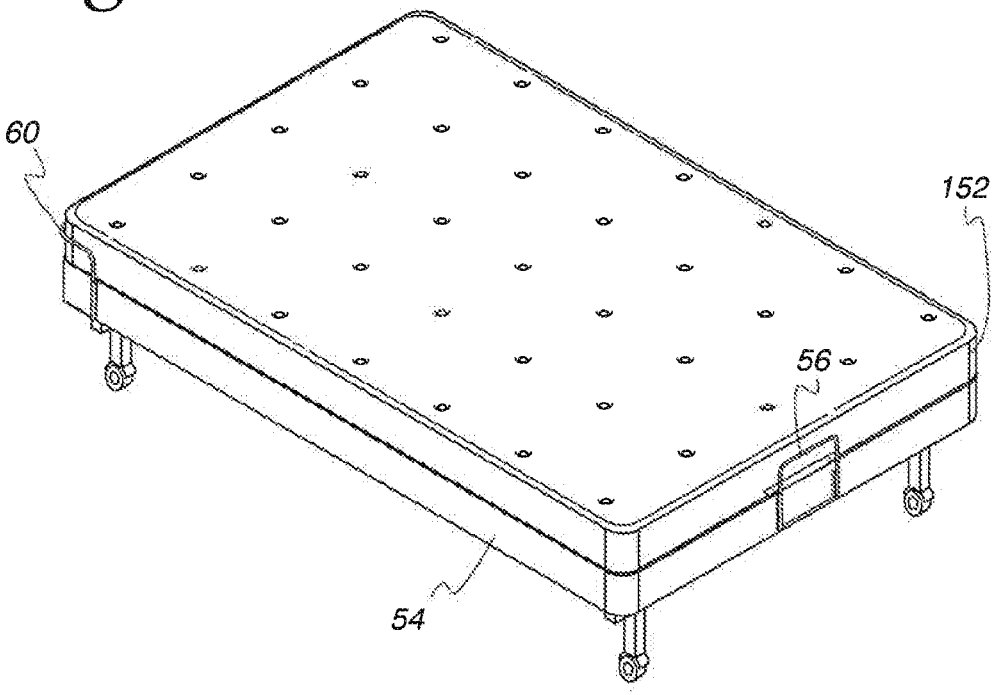
FIG. 18 is similar to FIG. 17 but shown with a mattress on top of the adjustable platform assembly.

As will be discussed in detail below various embodiments of the mattress retainer bar systems are disclosed. For example, FIGS. 1, 4-7, 10-12, 17 and 18 disclose embodiments of mattress retainer bar systems in which the retainer bar can be selectively lowered so that the top of the retainer bar is at a position below or flush with the underside of the mattress to allow the mattress to be rotated. Alternatively, the mattress retainer bars can be removed altogether. The mattress retainer bar systems disclosed in FIGS. 1 and 4-7 are suitable for use on the head or foot end of the bed. The mattress retainer bar systems disclosed in FIGS. 10-12 are for corners. FIGS. 17 and 18 illustrate an exemplary application of the retainer bars illustrated in FIGS. 1, 4-7 and 10-12.

Figure 15:
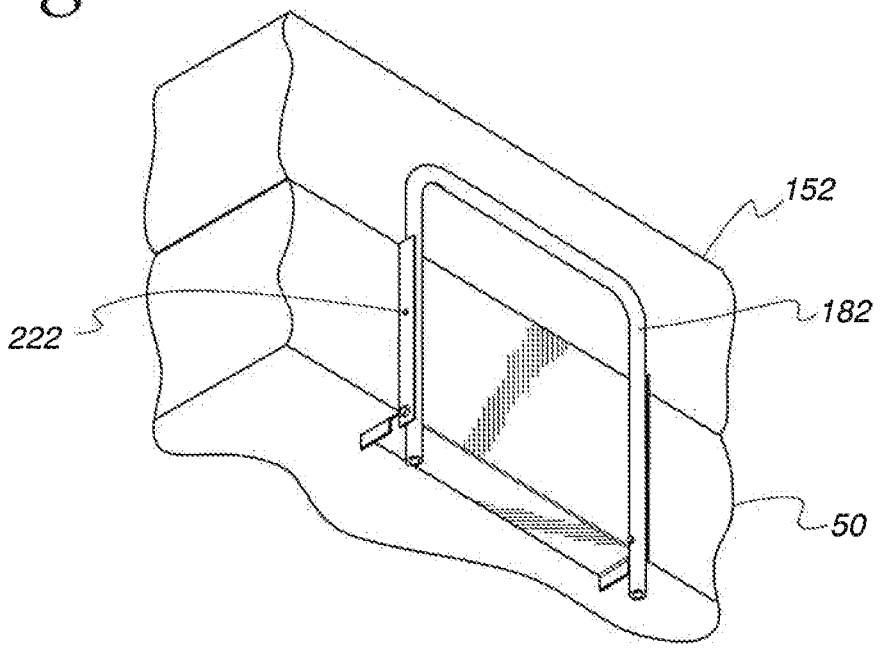
FIG. 15 is an isometric view of a portion of the adjustable platform assembly and mattress, shown with the bracket illustrated in FIG. 14 rigidly attached to one end of the adjustable platform assembly and further shown with the mattress retainer bar in an extended position.
Figure 16:
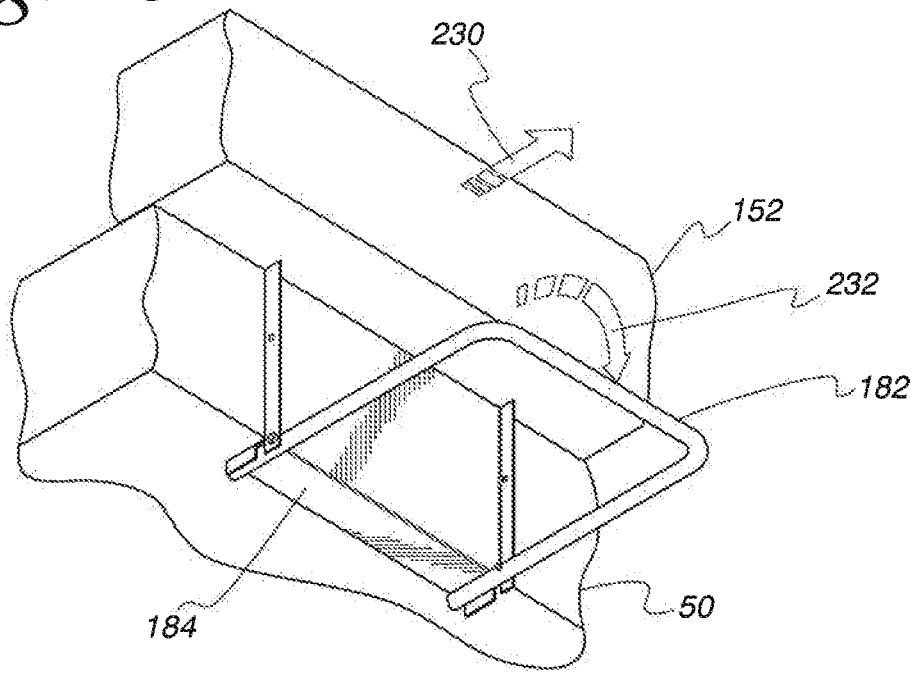
FIG. 16 is similar to FIG. 15 but shown with the mattress retainer bar in a fully retracted position and the mattress partially slid off the adjustable platform assembly.

FIGS. 15 and 16 illustrate embodiments of mattress retainer bar systems in which the mattress retainer bar can be rotated out of the way to enable the mattress to be rotated. FIGS. 20-23 illustrate mattress retainer bar systems in which one free end of mattress retainer bar is un-hooked from a bracket and the other free end is rotated so that the mattress retainer bracket is out of the way. These mattress retainer systems are suitable for use on the head or foot end of a bed.

FIGS. 24-31 illustrate embodiments of mattress retainer systems in which the retainer bars are removable and re-installable and can be used on the head/foot end of a bed. FIGS. 32-35 illustrate retainer bars for use on the corners of a bed. FIGS. 30, 31, 34 and 35 illustrate embodiments which rely on the weight of the mattress holding the retainer bar in place. These embodiments may be held in place by the weight of the mattress and optionally latch mechanisms, for example, as discussed below or other means. In the embodiments illustrated in FIGS. 24-29, 32 and 33 these retainer bars may also be held in place by a latch mechanism, as discussed below or other means.

Figure 36:
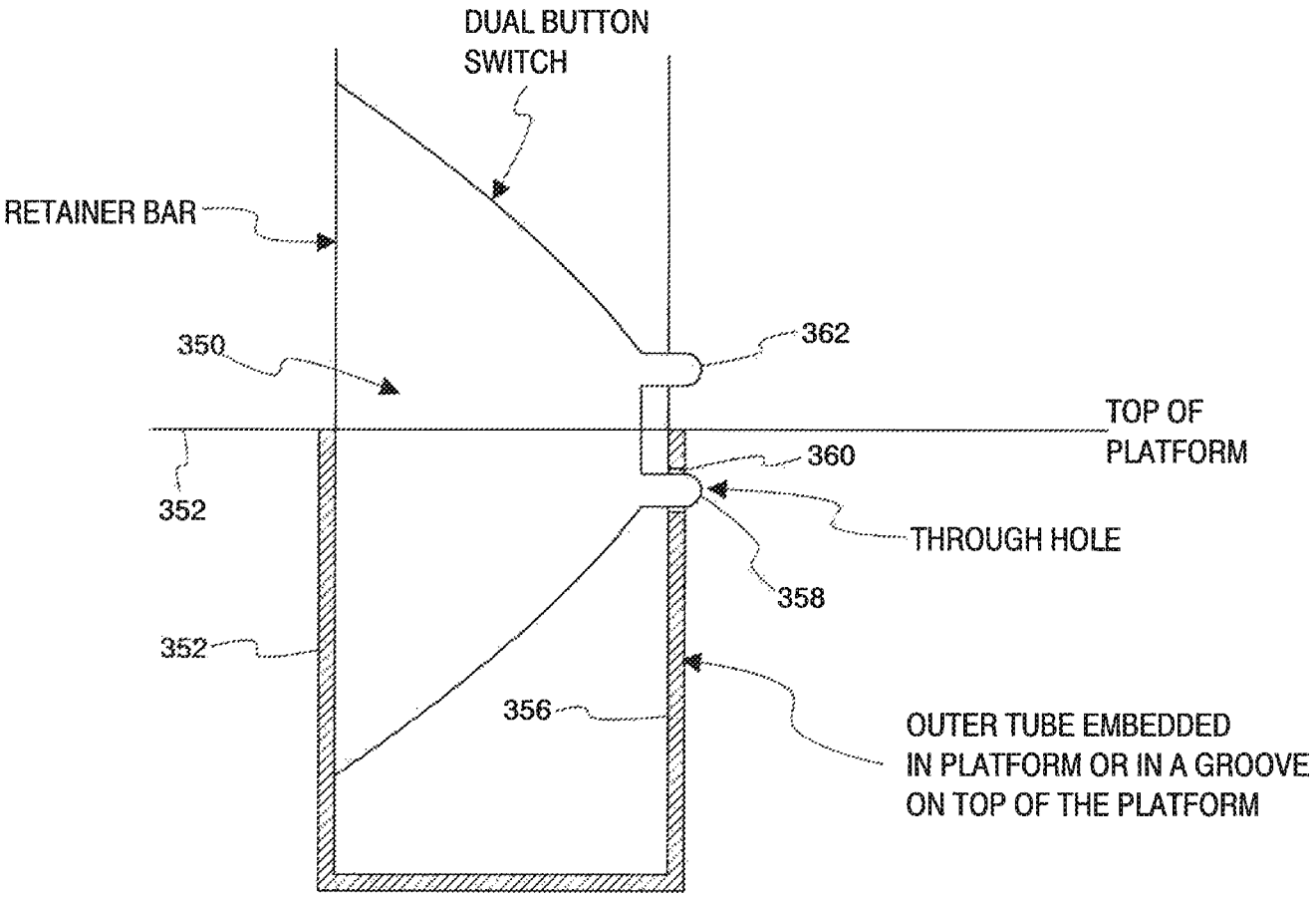
FIG. 36 is a partial section view in elevation of an exemplary latching assembly for latching and unlatching the retainer bar with respect to a bushing installed in the mattress platform for receiving the free ends of the retainer bars.
Figures 37, 38:
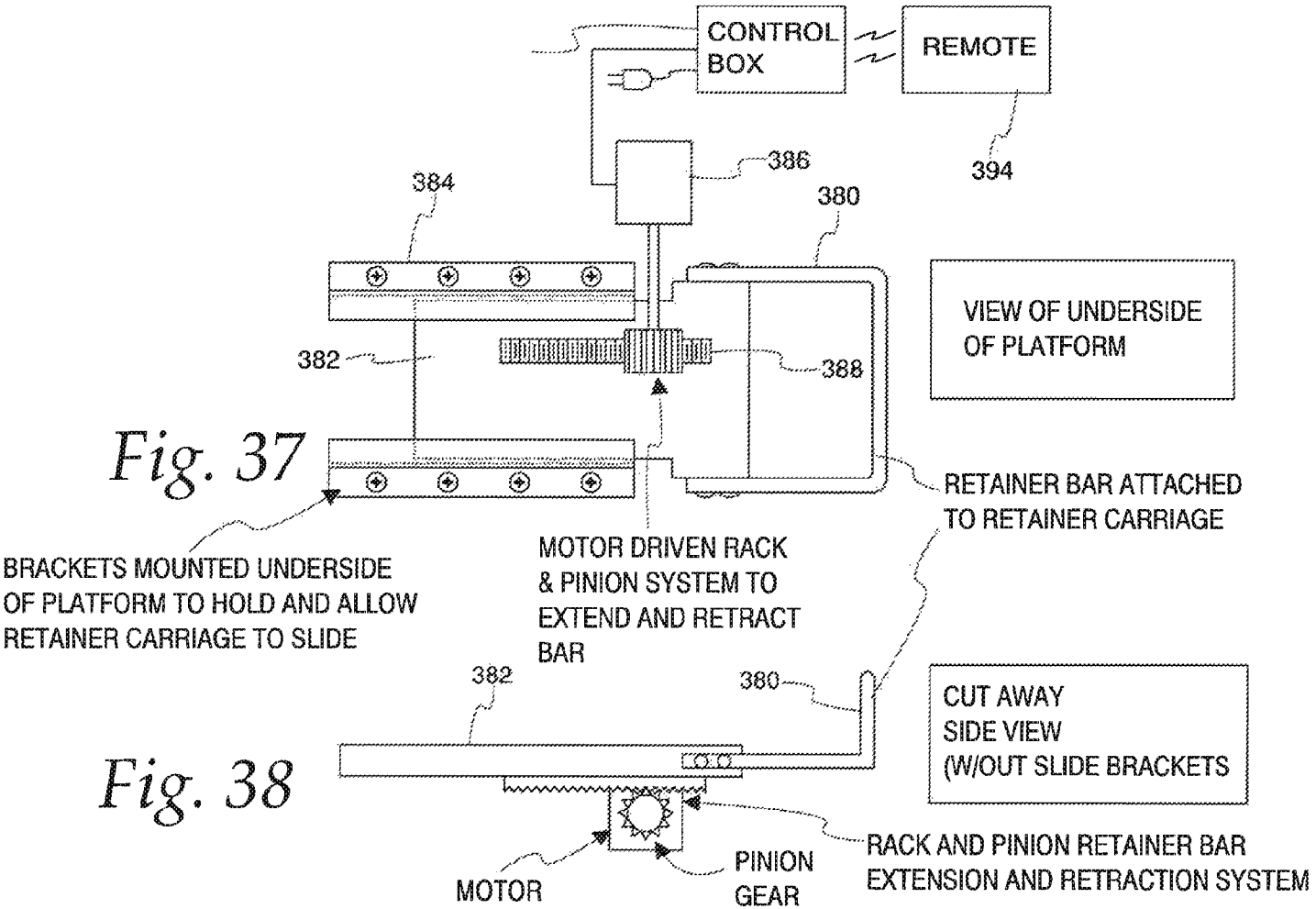
FIG. 37 is a bottom plan view of an exemplary embodiment of a motorized retainer bar.
FIG. 38 is cut away side view of the of the motorized retainer bar illustrated in FIG. 37.
Figure 39:
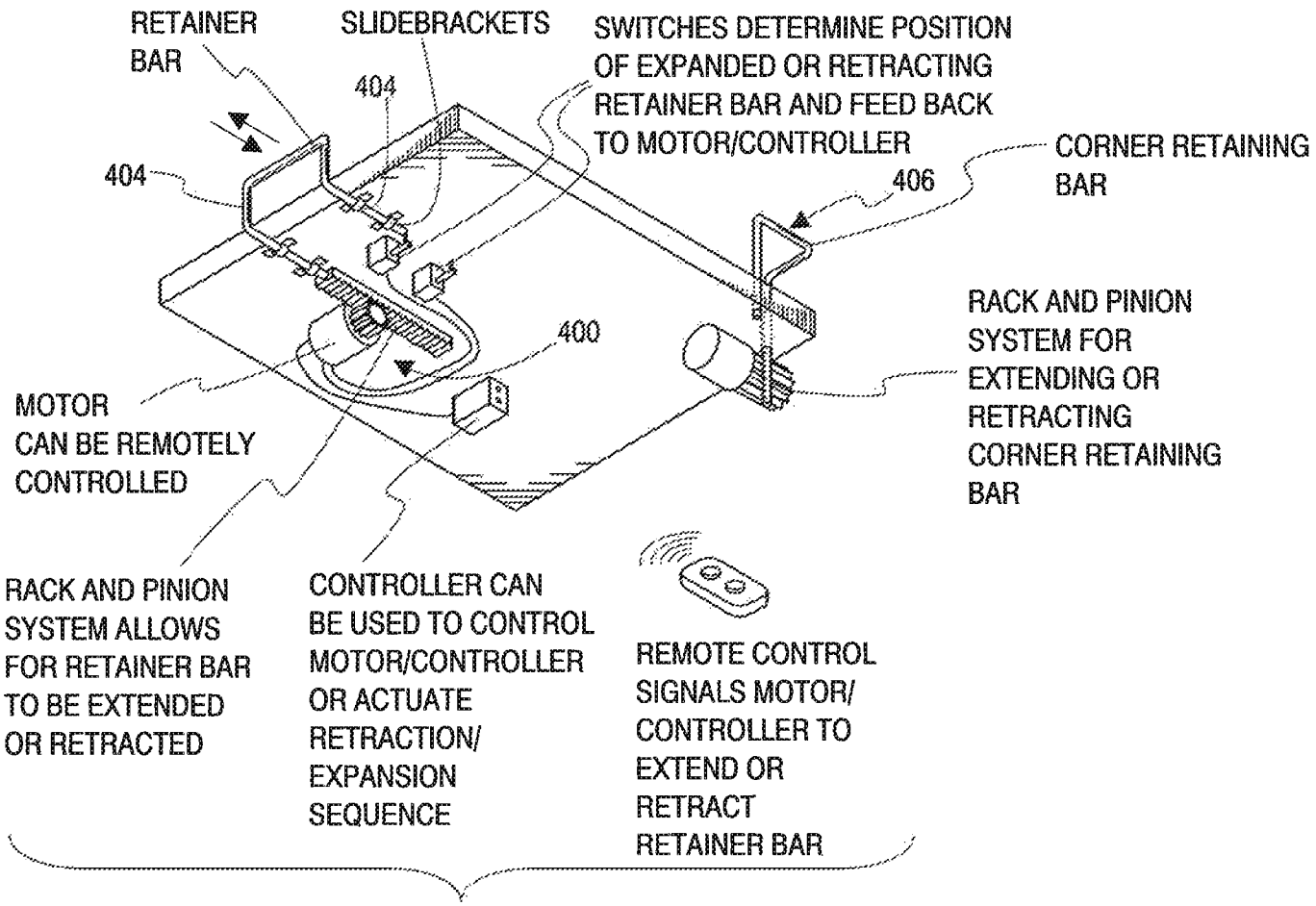
FIG. 39 illustrates an embodiment of the motorized retainer bars as applied to head/foot retainer bars as well as corner retainer bars in accordance with the present invention.
Figure 40:
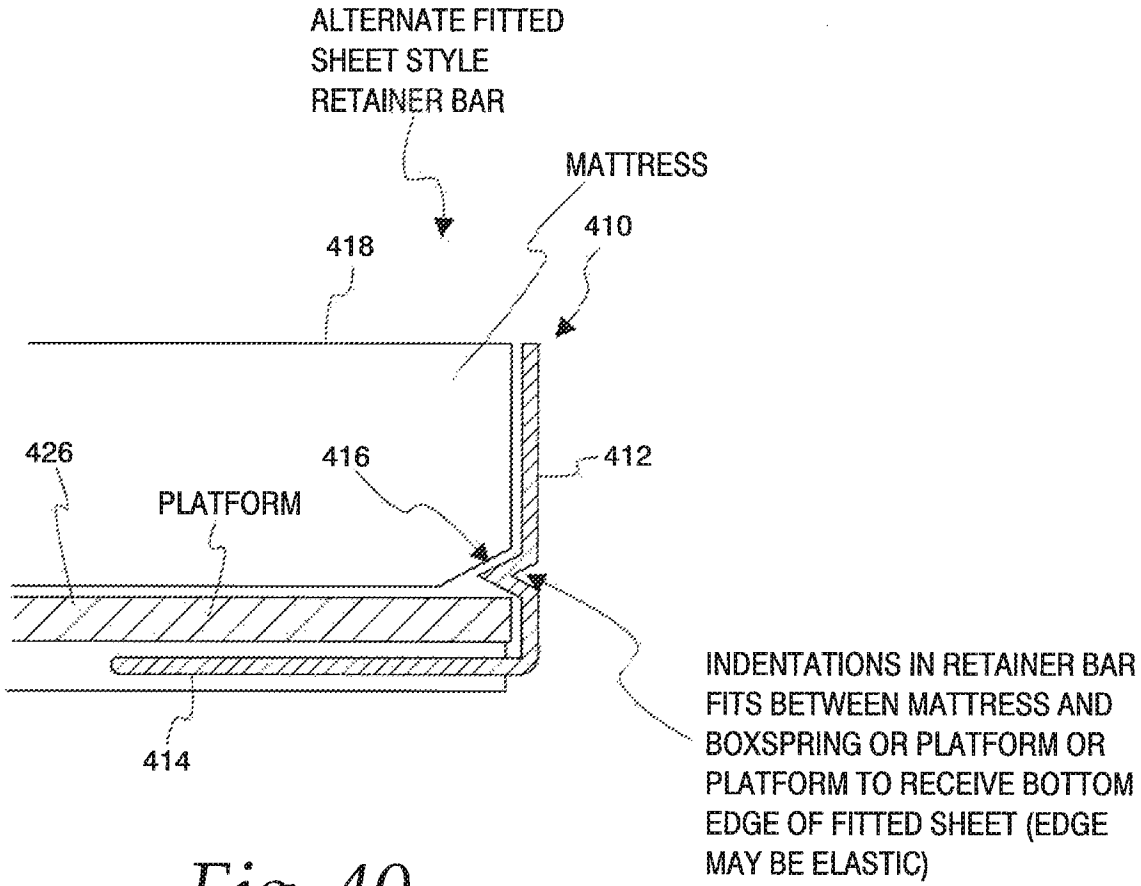
FIG. 40 illustrates an alternate embodiment of a retainer bar for use with fitted sheets.
Figures 41A, 41B, 41C:
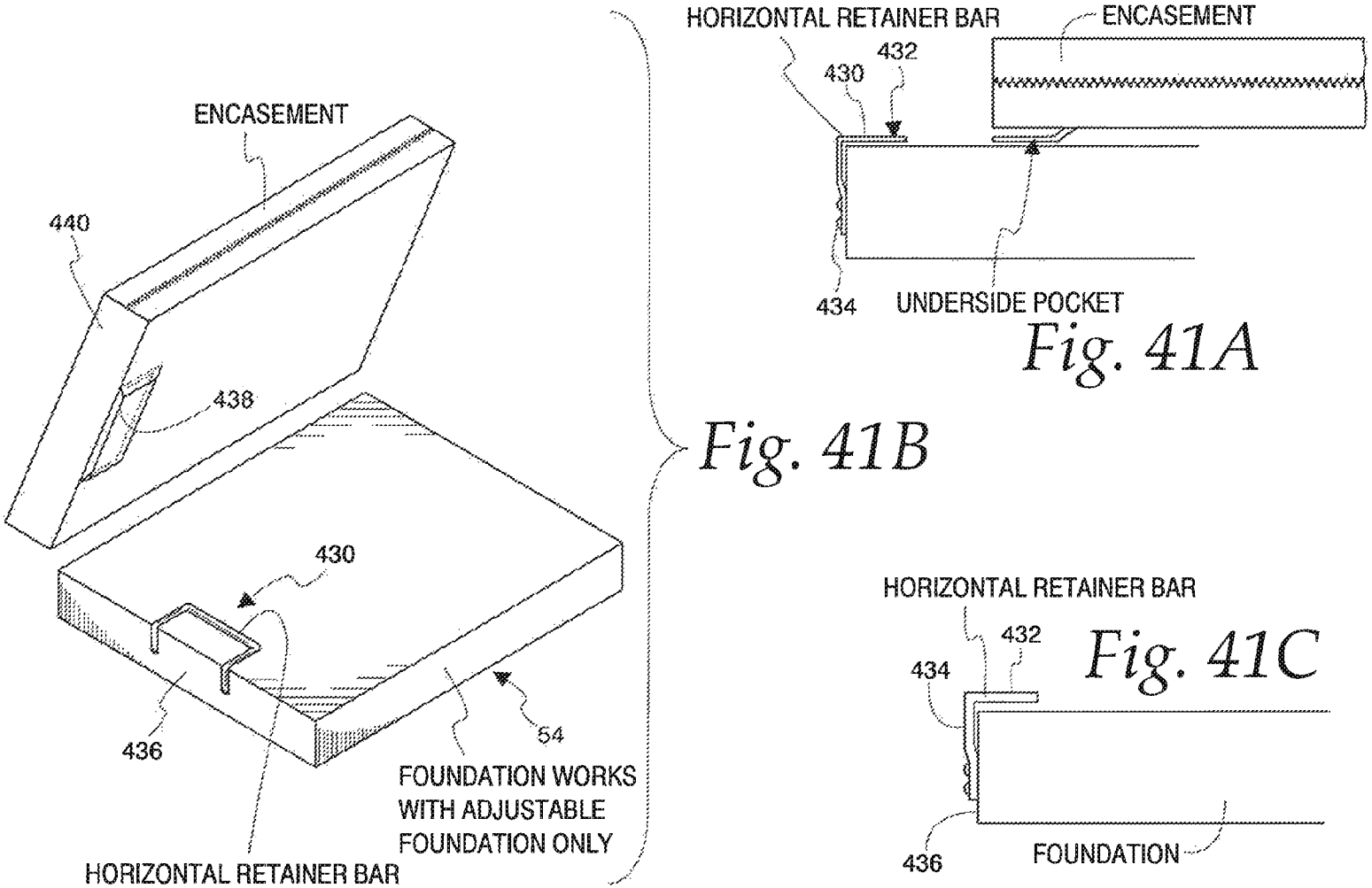
FIG. 41A illustrates a partial elevational view of an alternate embodiment of an "L" shaped retainer bar shown removed from a pocket on an underside of a mattress encasement.
FIG. 41B is an isometric view of a mattress platform with the retainer bar illustrated in FIG. 41A and a mattress encased with an encasement with a pocket on its underside for receiving the retainer bar, shown with the encased mattress removed.
FIG. 41C is a partial elevational view of the "L" shaped retainer secured to a mattress platform.

FIG. 36 illustrates an embodiment of an exemplary latch mechanism for use with the removable retainer bars, as discussed above, in accordance with the present invention. FIGS. 37-39 illustrate an exemplary embodiment of a motorized retainer bar system. FIG. 40 illustrates a retainer bar system for use with fitted sheets. FIGS. 41A-41C illustrate an alternate embodiment of an "L" shaped retainer bar that is secured to the mattress platform and configured to be received in a pocket in an underside of a mattress encasement.

Figure 1:
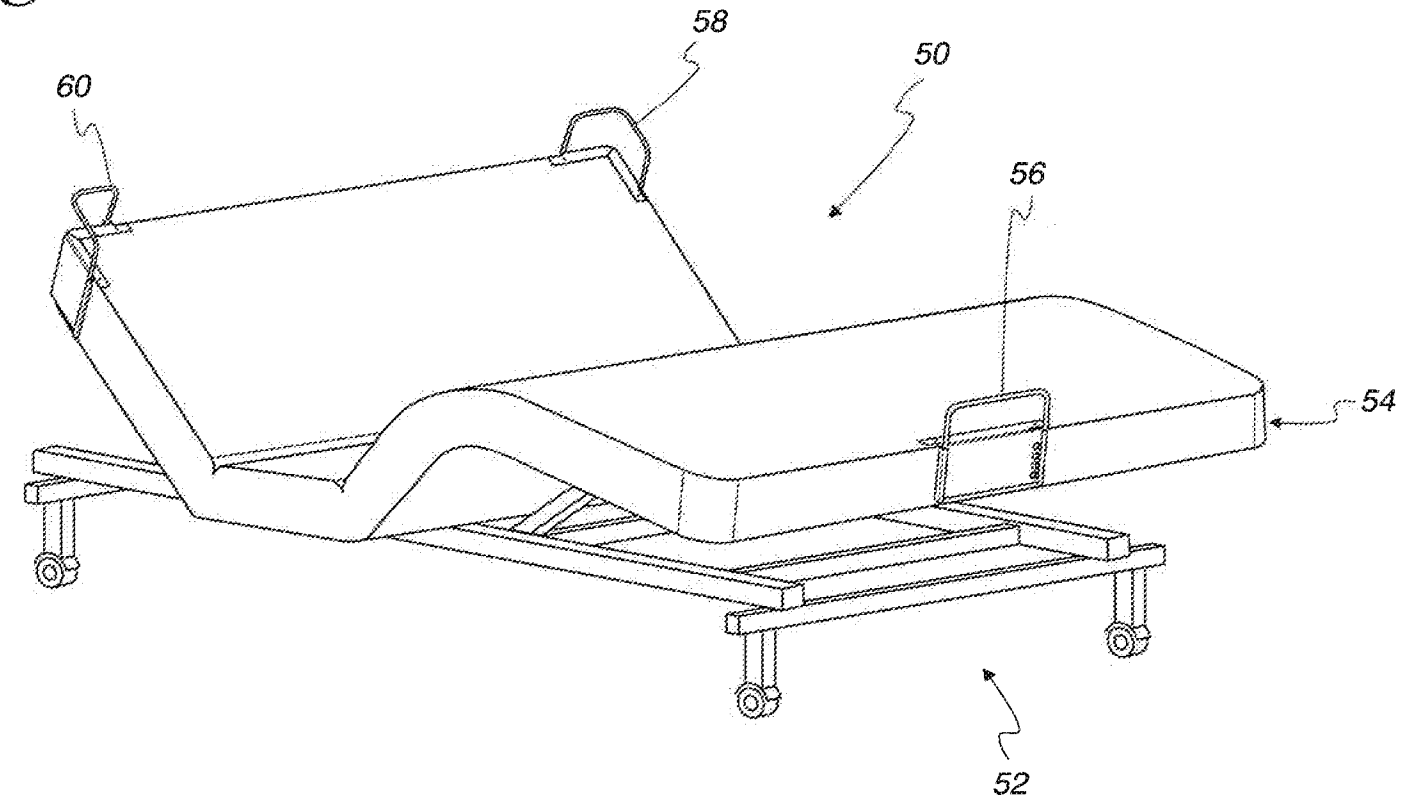
FIG. 1 is an isometric view of a known adjustable platform assembly, shown in a contorted position illustrating the mattress retainer bars in accordance with the present invention attached to the corners on one end and to a foot end on the opposing end.
Figure 14:
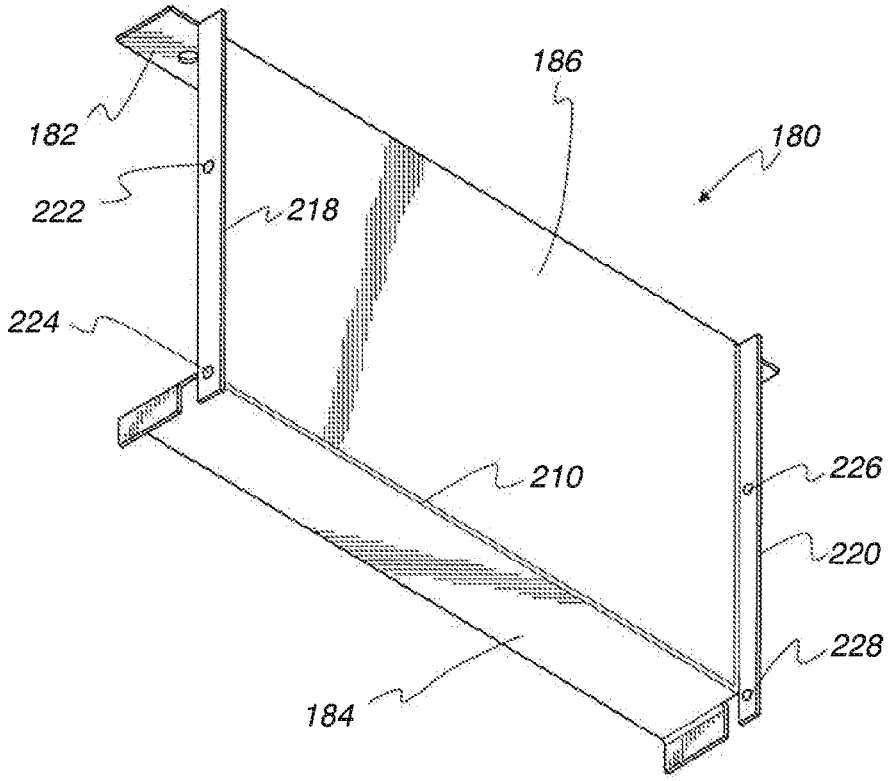
FIG. 14 an isometric view of the bracket illustrated in FIG. 13, shown after it has been formed into a bracket for use with an alternate embodiment of the invention for use as a mattress retainer bar for the head and foot ends of the bed.

The retainer bar systems illustrated and described herein may be incorporated into the mattress platform 54 in various ways. For example, FIGS. 1-23 illustrate embodiments of the mattress retainer bar systems which utilize a bracket attached to the outside vertical wall of the mattress panel 54 (FIG. 1). In the embodiments illustrated in FIGS. 1, 4-7 and 10-12, decorative fabric may be used to conceal the brackets. In the embodiments illustrated in FIGS. 15 and 16, decorative fabric may be used to cover the bracket with a slit for the spaced apart rails 218 and 220 (FIG. 14).

FIGS. 20-23 illustrate an alternate embodiment mattress retainer bar system that is attached to the outside vertical wall of the mattress panel 54. In this embodiment, it is contemplated that the decorative cover is attached to the outside vertical wall of the mattress panel 54 and the brackets 258 and 260 are attached over the decorative fabric.

FIGS. 24-35 illustrate an alternate embodiment in which no part of the mattress retainer bar system is attached to the outside vertical wall of the mattress panel 54. As such, the outside vertical wall of the mattress panel 54 can be covered with a decorative fabric.

Referring first to FIG. 1, a conventional adjustable mattress platform assembly is illustrated and identified with the reference numeral 50. An example of such an adjustable mattress platform assembly is disclosed in detail in US Patent Application Publication No. US 2014/0325761 A1, hereby incorporated by reference. Such adjustable platform assemblies 50 are motorized and enable a user to select various contorted positions, normally by way of a remote control device (not shown). Known adjustable platform assemblies include a carriage assembly, generally identified with the reference numeral 52, and mattress platform or upper support 54. The mattress platform 54 is normally formed from a stiff material, such as upholstered wood, metal, or particle board) and is formed in sections, some of which are pivotally mounted with respect to the carriage assembly 52 in order to allow the contortions of the mattress into various user selected positions.

As shown in FIG. 1, a mattress retainer bar 56 in accordance with the invention is disposed at one end of the adjustable platform assembly 50. A pair of mattress retainers 58 and 60 in accordance with an alternative aspect of the invention is disposed on the corners of the upper support 54 of the adjustable platform assembly 50 on opposing corners.

Two types of mattress retainer assemblies in accordance with the invention are contemplated. One type is designed to be typically secured to the head or foot end of the upper support 54 of the adjustable platform assembly 50. An exemplary version of this type of mattress retainer bracket is identified with the reference numeral 56 (FIG. 1) and is also referred to as an "end" mattress retainer assembly. The end mattress retainer assembly can be used on the head and foot ends of the upper support 54 of the adjustable platform assembly 50. The end mattress retainer assembly can also be used on the sides of the upper support of the adjustable platform assembly 50. The second type of mattress retainer assembly is designed to be attached to one or more of the corners of the upper support 54 of the adjustable platform assembly 50 and is also referred to as a "corner" mattress retainer assembly. An exemplary version of this type of mattress retainer is illustrated in FIG. 1 and identified with the reference numerals 58 and 60.

Multiple configurations of the mattress retainer bars 56, 58 and 60 (FIG. 1) with respect to their placement relative to the adjustable platform assembly 50 are possible. In particular, the mattress retainer bars 58 and 60 on the corners of the mattress platform 54 of the adjustable platform assembly 50 at the head end can be omitted. Alternatively, the mattress retainer bar 56 at the foot end of the adjustable platform assembly 50 can be omitted and replaced with mattress retainer bars 58 and 60 on the corners of the upper support 54 adjustable platform assembly 50 at the foot end. Alternatively, any number of retainer bars can be used at the head and foot of the adjustable platform assembly to hold the mattress in place.

The embodiments described and illustrated herein are merely exemplary. Other variations of head and foot end and corner mattress retainer assemblies are contemplated. The mattress retainer system in accordance with the present invention need only be either moveable or removable and re-installable and have a retracted position in which the mattress retainer bar is configured to retain the position of the mattress relative to the adjustable platform assembly 50 and an extended position in which the mattress retainer bar can selectively be placed below the top surface of the upper support 54 of the adjustable platform assembly 50; and an optional mechanism for securing the mattress retainer bar in an extended position. All such embodiments which meet the above criteria are considered to be within the broad scope of the invention.

Figure 2:
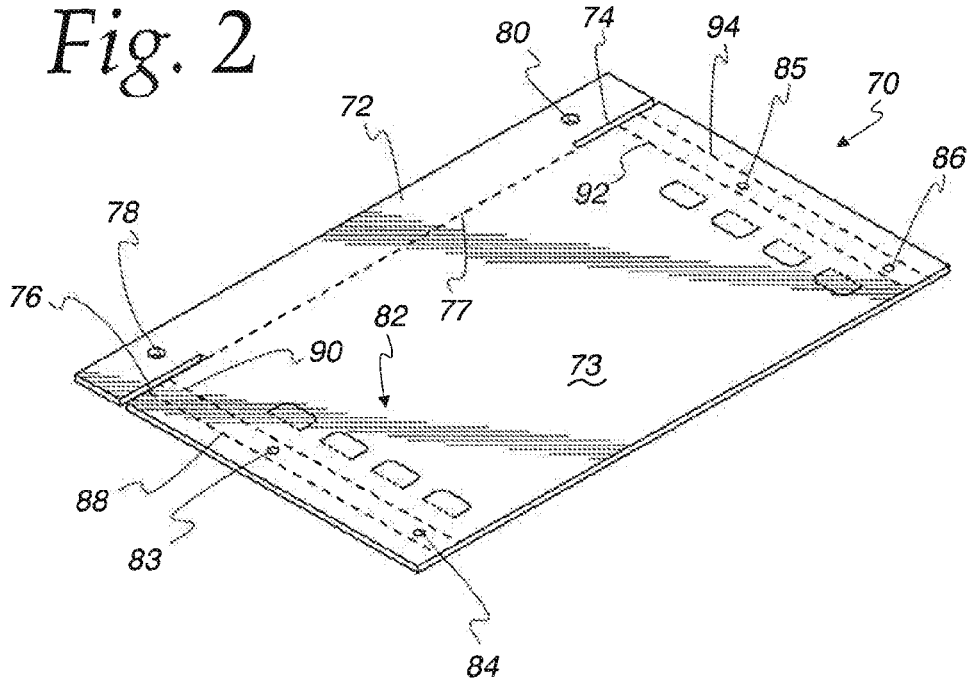
FIG. 2 is an isometric view of an un-formed bracket for use with the invention.
Figure 3:
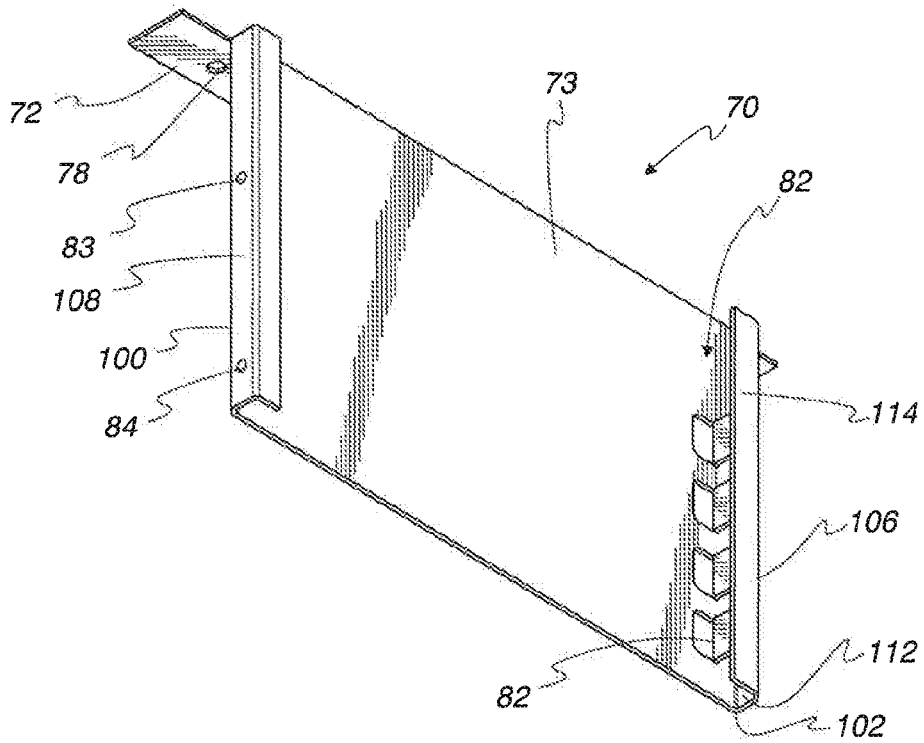
FIG. 3 an isometric view of the bracket illustrated in FIG. 2, shown after it has been formed into a bracket for use with mattress retainer bars for the head and foot ends of the bed.

As mentioned above, the mattress retainer assembly in accordance with the present invention may include a bracket, a mattress retainer bar and a mechanism. An exemplary embodiment for one such bracket for an end type mattress retainer assembly is illustrated in FIGS. 2 and 3. As shown in FIG. 2, the bracket, general identified with the reference numeral 70, can be stamped from a blank consisting of a flat piece of rigid material. As shown the blank includes a top flange portion 72 that is designed to be secured to a top surface of the upper support 54 of the adjustable platform assembly 50 and a bracket portion 73. The flange portion 72 is formed by providing opposing aligned slits 74 and 76 on opposing ends of the blank and spaced from the top of the blank to define the width of the flange portion 72. The blank may be under scored between the opposing slits 74 and 76, as indicated by the dashed line 77, to facilitate bending of the flange portion 72 so that it is generally perpendicular to the plane of the bracket portion 73. A pair of mounting holes 78 and 80 is provided in the flange portion 72 to enable the bracket 70 to be secured to a top surface of the upper support 54 of the adjustable platform assembly 50 with suitable conventional fasteners. A number of aligned spaced apart tabs, generally identified with the reference numeral 82, are formed adjacent opposing ends of the bracket. As shown, four tabs are shown on each end. As shown in FIGS. 3, 4, 6 and 7, the tabs 82 are bent upwardly to a position generally perpendicular to the bracket portion 73. Through holes 83, 84 and 85, 86 are formed adjacent opposing ends of the bracket portion 73. In this exemplary embodiment the through holes 83, 84 and 85, 86 form part of the detent mechanism. As will be discussed in more detail below, the through holes 83 and 85 are define an extended position while the holes 84 and 86 may be used to define a retracted position or eliminated altogether.

Each end of the bracket portion 73 is under scored with a pair of parallel spaced apart scores 88, 90 and 92, 94. These under scores are used to facilitate bends along the ends of the bracket portion 73. Specifically, the bends 90 and 92 facilitate the bends 100 and 102 while the under scores 88 and 94 facilitate the bends 104 and 106. The bends 100 and 104 form a sidewall portion 108 and a top wall portion 110 on one end of the bracket portion 73. Similarly, the bends 102 and 106 form a sidewall portion 112 and a top wall portion 114.

A portion of the bracket portion 73, the side wall 108, the top wall 110 as well as the tabs 82, bent up toward the top wall 110 form a cavity for receiving and providing a track for one leg of a mattress retainer bar. Similarly, a portion of the bracket portion 73 on an opposing end, the side wall 112, the top wall 114 as well as the tabs 82, bend up toward the top wall 114 to form a cavity for receiving and providing a track for the other leg of a mattress retainer bar.

Figure 19:
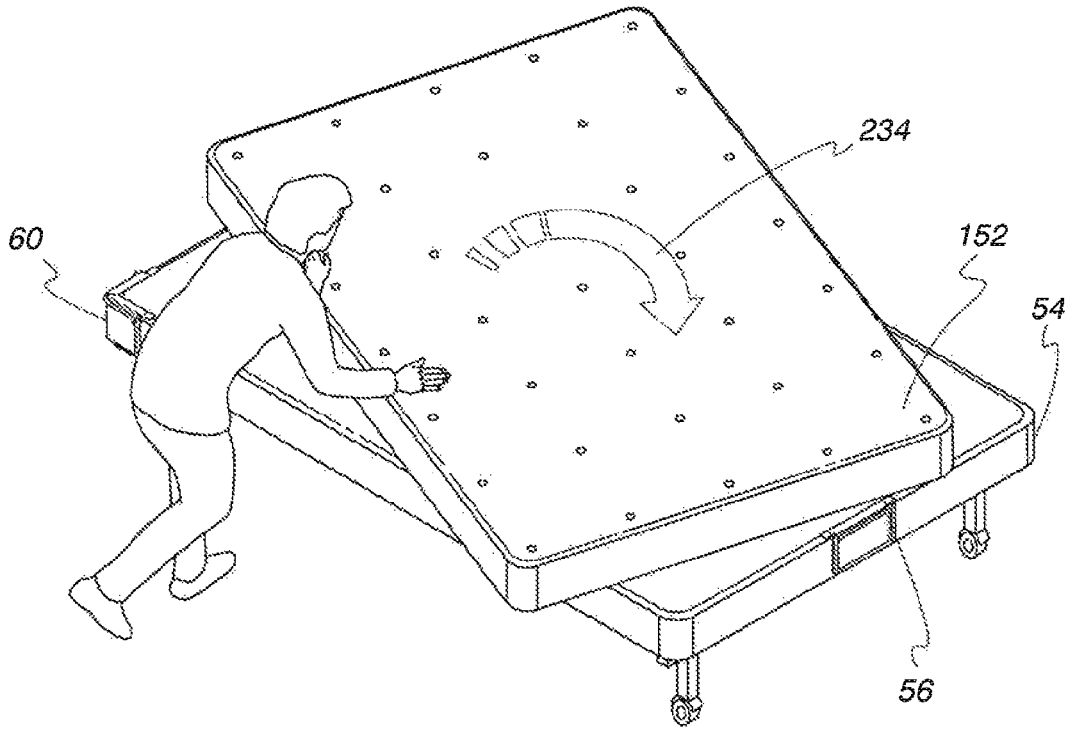
FIG. 19 is similar to FIG. 18 but shown with the various mattress retainer bars all in a retracted position, illustrating rotation of a mattress.

With reference to the embodiments illustrated in FIGS. 4-7, this mattress retainer system includes a mounting bracket 70 (FIG. 3) that may be secured to one end the mattress panel 54 (FIG. 1) of the adjustable platform assembly 50; a mattress retainer bar 126 (FIG. 4); and an exemplary latch or other mechanism 128. The mechanism 128 is used to latch the mattress retainer bar in a fully extended position, for example, as illustrated in FIG. 18, or alternatively allow the mattress retainer bar to be placed in a retracted position, as illustrated in FIG. 19 to allow the mattress to be rotated with respect to the upper support 54 of the adjustable platform assembly 50.

Figure 4:
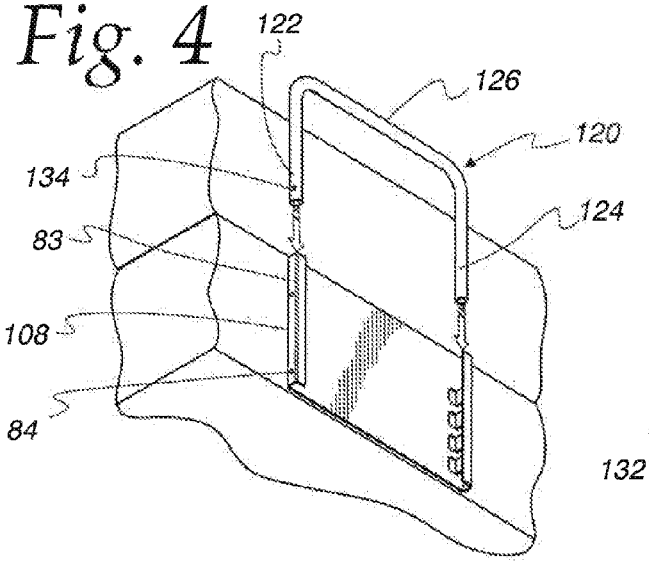
FIG. 4 is an isometric illustrating a section of the adjustable platform assembly and mattress with the bracket illustrated in FIG. 3 rigidly attached to one end of the adjustable platform assembly, shown with a mattress retainer bar removed.

One embodiment of a mattress retainer bar for an end mattress retainer assembly is best illustrated in FIG. 4 and generally identified with the reference numeral 120. The mattress retainer bar includes a pair of spaced apart legs 122 and 124 connected together by a bight portion 126. As shown in FIG. 4, the opposing legs are received in the cavities formed in the bracket as discussed above.

Figure 5:
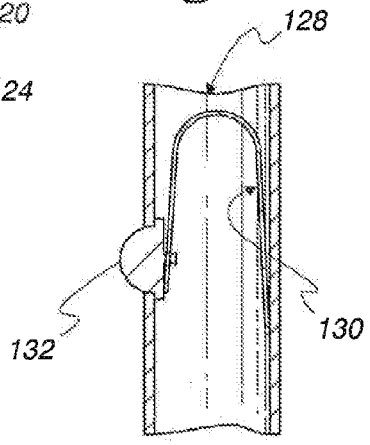
FIG. 5 is a partial vertical section view of a portion of the mattress retainer bar, shown with a button pin arrangement in a detent position.

As illustrated in FIG. 5, the mattress retainer bar 120 is formed from a hollow tube and includes a mechanism consisting of a spring loaded button, generally identified with the reference numeral 128 which is formed from a spring 130 and a button 132. Each of the legs 122 and 124 are formed with a through hole. These through holes 134 are for receiving the spring loaded button 132, as illustrated in FIG. 5.

As mentioned above, each of the legs 122 and 124 is received in the cavities formed on the opposing ends of the bracket 70. The mattress retainer bar 120 is inserted into the cavities until the button 132 on each leg 122, 124 is received in the top most holes 83 and 85 (FIGS. 2 and 4) formed in the side walls 108 and 112. The cavities are sized such that as the respective legs 122 and 124 are inserted into the cavities, the respective buttons 132 on each of the legs 122, 124 is pushed inwardly against the force of the spring 130. As the buttons 132 become aligned with the holes 83 and 85 (FIG. 2) in the cavities, the buttons 132 are pushed out under the force of the springs 130 and are received in the holes 83 and 85 to define a first position or extended position, as illustrated in FIG. 6.

Figure 6:
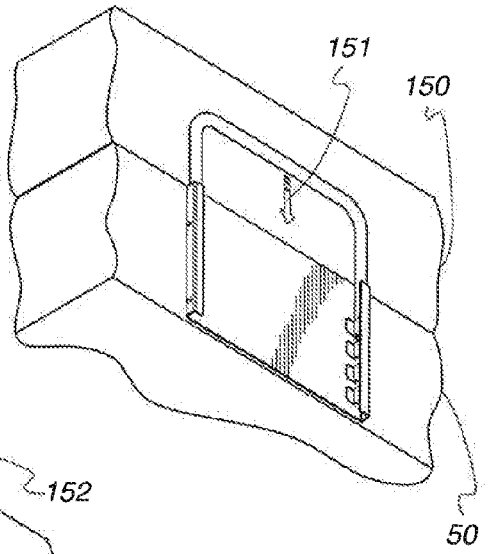
FIG. 6 is an isometric view of a portion of the adjustable platform assembly and mattress, shown with the bracket illustrated in FIG. 3 rigidly attached to the adjustable platform assembly and the mattress retainer bar partially installed in the bracket.

As shown in FIG. 6, a mattress 150 is supported on top of a support surface of an adjustable platform assembly 50. A bracket 70 is mounted to the support surface 54 of the spring retainer assembly 50. With the mattress retainer bar 120 in an extended position, as shown, the mattress 150 is constrained from moving in the direction by the arrow 152, as shown in FIG. 7.

Figure 7:
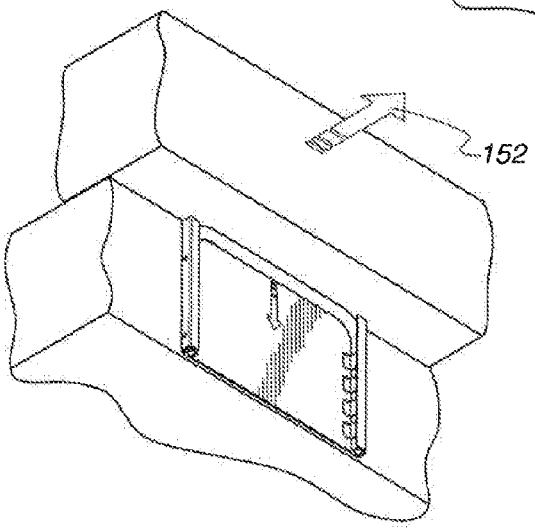
FIG. 7 is similar to FIG. 6 but shown with the mattress retainer bar in a fully retracted position and the mattress partially slid off the adjustable platform assembly.

In order to place the spring retainer bar in a retracted position, as shown in FIG. 7, the buttons 132 on the legs 122 and 124 of the mattress retainer bar 120 are pushed inwardly against the force of the springs 130. The spring retainer bar 120 is moved further downwardly in the direction of the arrow 151 until the buttons 132 pop into the holes 84 and 86 (FIG. 2) in the bracket 70, which defines a second detent position or a retracted position, as shown in FIG. 7. In a retracted position, as shown in FIG. 7, the mattress retainer bar is below the top surface of the upper support 54 of the adjustable platform assembly 50 to allow the mattress to move in the direction of the arrow 152, past the plane of the mattress retainer bar 120 to enable the mattress to slide or be rotated.

The holes 84 and 86 in the bracket 70 can optionally be omitted. In this embodiment, downward travel of the mattress retainer bar will be limited by the bight portion 126 of the mattress retainer bar 120 striking the top tabs 82 on the bracket 70.

FIGS. 8-12 relate to corner mattress retainer assemblies. The construction of the bracket 160 for the corner mattress retainer 58, 60 (FIG. 1). The bracket 160 for the corner mattress retainer assembly 58, 60 is similar to the bracket 70 for the end mattress retainer assembly 56. For brevity, only the differences will be discussed. All of the rest of the manufacturing details are the same.

Figure 8:
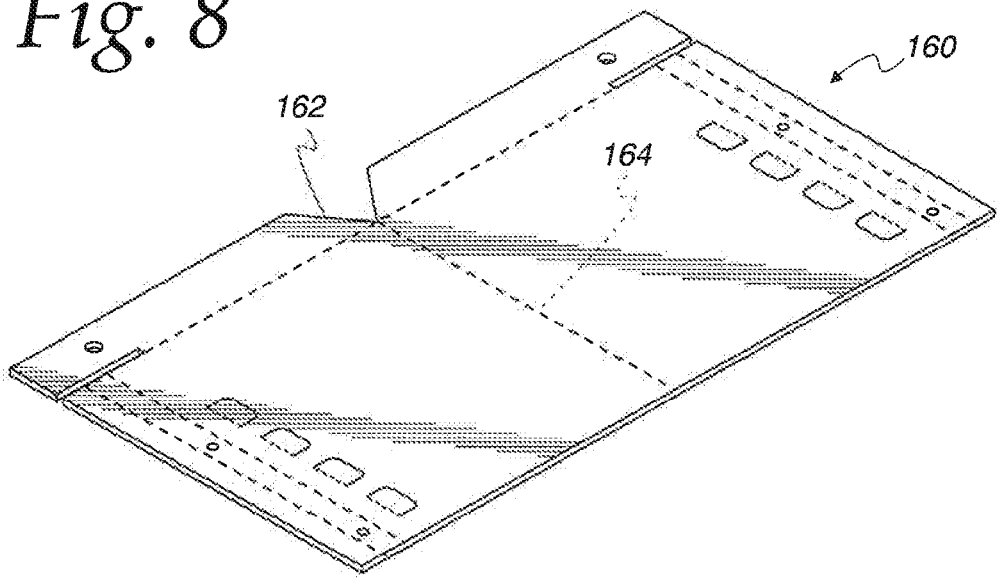
FIG. 8 is similar to FIG. 2 but for a corner mattress retainer bar.
Figure 9:
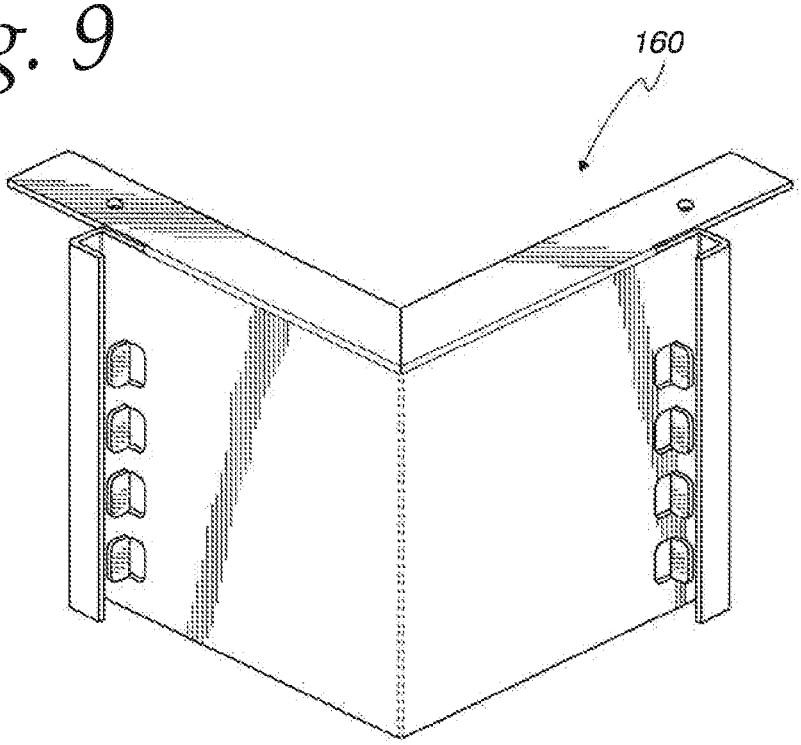
FIG. 9 an isometric view of the bracket illustrated in FIG. 8, shown after it has been formed into a bracket for use with mattress retainer bars for the mattress corners.

Referring first to FIG. 8 a "V" 162 is cut out of the center of the top edge of the bracket 160. In addition, the center of the bracket 160 is under scored, as indicated by the dotted line 164. These additional details allow the bracket 160 to be bent along the under score 164 forming two halves that are mutually perpendicular to each other, as shown in FIG. 9.

The mattress retainer bar 166 (FIG. 10) for the corner mattress retainer assembly 58, 60 (FIG. 1) and includes a pair of spaced apart parallel legs 166 and 168 connected together by a bight portion 172. The bight portion 172 is bent and follows the radius of curvature of the rounded mattress corner 174.

The mattress retainer bar 166 is formed from a hollow tube and includes a mechanism, as discussed above. As shown in FIG. 11, the mattress retaining bar 166 is received in the cavities formed in the bracket 160 and moved downwardly in the direction of the arrow 175 until the mechanism, such as the mechanism discussed above, reaches the extended detent position. In this position the mattress is restrained from moving beyond intersecting planes of the bracket 160.

In order to move the mattress in the direction of the arrow 176, the mattress retainer bar is moved to the retracted position, as shown in FIG. 12. In this position, the mattress retainer bar is below the bottom surface of the mattress 152 in order to allow the mattress 152 to slide in the direction of the arrow 176 or be rotated.

FIGS. 13-16 illustrate an alternative embodiment of an end mattress retainer assembly. This embodiment also includes a bracket 180. This embodiment includes a pivotally mounted mattress retainer bar 182 (FIG. 15). The bracket 180 can be stamped from a blank consisting of a flat piece of rigid material. As shown the bracket 180 includes a top flange portion 182 that is designed to be secured to a top surface of the upper support 54 of the adjustable platform assembly 50. The bracket 180 also includes a bottom flange portion 184 and a bracket portion 186. The top flange portion 182 is formed by providing opposing aligned slits 187 and 188 on opposing ends of the blank and spaced from the top of the blank to define the width of the top flange portion 182. The blank may be under scored between the opposing slits 187 and 188, as indicated by the dashed line 190, to facilitate bending of the top flange portion 182 so that it is generally perpendicular to the plane of the bracket portion 186. A pair of mounting holes 192 and 194 is provided in the top flange portion 182 to enable the bracket 180 to be secured to a top surface of the upper support 54 of the adjustable platform assembly 50 with suitable conventional fasteners.

The bottom flange portion 184 is disposed on the underside of the upper support surface 54, as generally shown in FIGS. 15 and 16. In order to form the lower flange portion 184, an under score is provided, as indicated by the dashed line 189. Two slits 200 and 202 are provided adjacent opposing edges of the bracket 180 along with two perpendicular under scores 204 and 206. As shown best in FIG. 14, such a configuration allows the lower flange port 184 to be bent along the line 210.

A pair of under scores 212 and 214 adjacent opposing edges of the bracket 180. These under scores allow the edges to be bent in a generally perpendicular direction from the bracket portion 186 defining a pair of spaced apart side walls Each of the side walls 218 and 220 includes a pair of through holes 222, 224 and 226, 228. The holes 224 and 228 form a pivot axis. The though holes 222 and 226 form part of the detent mechanism, as will be discussed in more detail below.

Turning to FIGS. 15 and 16, the mattress retainer bar 182 is similar to the mattress retainer bars discussed above with the exception that it is pivotally mounted relative to the rails or sidewalls 218 and 220. The configuration of the bottom flange portion 184 allows the pivot axis to extend below the bottom surface of the upper support 54.

FIG. 15 illustrates an extended position. Spring loaded buttons (not shown) in the mattress retainer bar 182 are received in the holes 222 (FIG. 14) and 226 in the side walls 218 and 220, respectively to secure the mattress retainer bar 182 in the extended position, as shown in FIG. 15 to prevent movement of the mattress 152 with respect to the upper support 54 of the platform assembly 50.

In order to slide the mattress 152 in the direction of the arrow 230 or rotate the mattress 152, the spring loaded buttons (not shown) are pushed inwardly and the mattress retainer bar 182 is rotated in the direction of the arrow 232 to allow the mattress retainer bar to be rotated to the extended position, as shown in FIG. 16. In this position, the mattress retainer bar 182 is below the top surface of the upper support 54 of the adjustable platform assembly 50 to allow the mattress 152 to be moved in the direction of the arrow 230 and rotated.

FIG. 17 illustrates an exemplary application of the invention. In this embodiment, an end mattress retainer assembly 56 is disposed at a foot end of an upper support of an adjustable support assembly 50 and corner mattress retainer assemblies 58 and 60 are disposed on opposing corners at the head end. FIG. 18 illustrates a mattress disposed on top of the upper support 54 of an adjustable support assembly 50 in a flat position. As shown the mattress retainer assemblies 56, 58 and 60 are latched in an extended position. In order to rotate the mattress 152 in the direction of the arrow 234, the head mattress retainer assembly 56, as well as the corner mattress retainer assemblies 58 and 60 are placed in a retracted position, as shown. After the mattress 152 is rotated 180 degrees, the head mattress retainer assembly 56 and the corner mattress retainer assemblies 58 and 60 are returned to an extended position, as shown in FIGS. 17 and 18.

Figure 20:
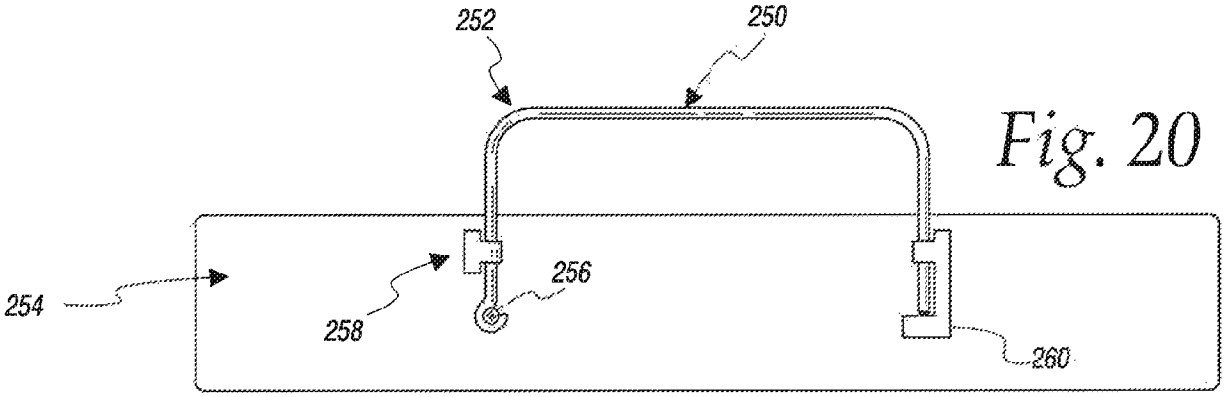
FIG. 20 is an alternate embodiment of the mattress retainer system, illustrating a mattress retainer bar located at one end of the bed that pivots in a plane generally perpendicular to plane of the mattress, shown in a normal position.
Figure 21:
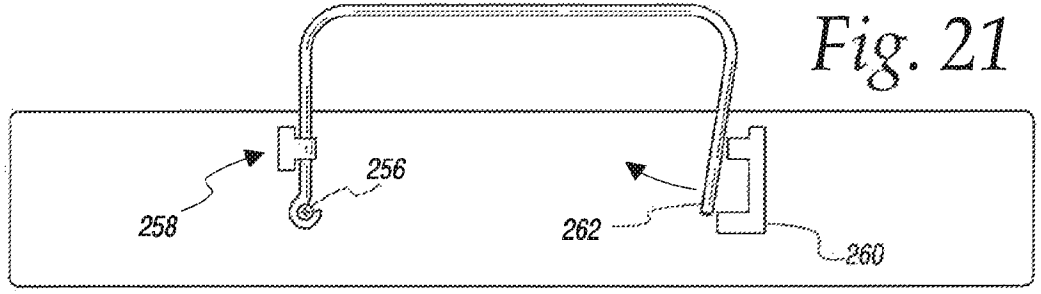
FIG. 21 illustrates the mattress retainer system illustrated in FIG. 20 in an intermediate position.
Figure 22:
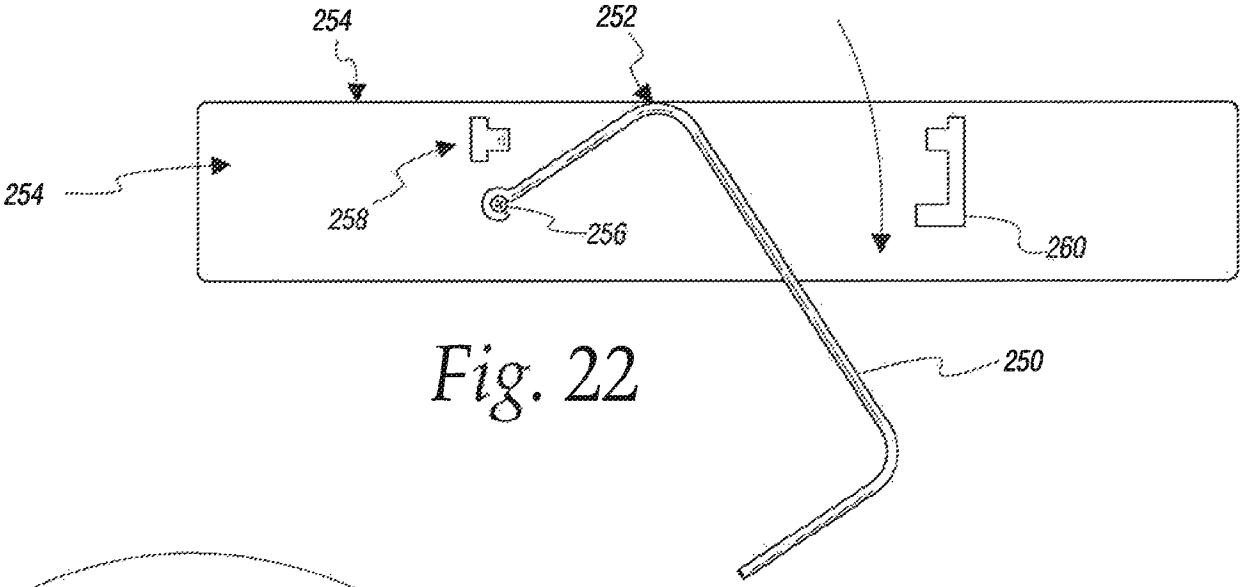
FIG. 22 illustrates the mattress retainer system illustrated in FIG. 20 in an extended position.

FIGS. 20-22 illustrate another alternate embodiment of a mattress retainer system, which includes a U-shaped retainer bar 250 that pivots on one end about a pivot axis. In this embodiment, the retainer bar 250 rotates in a clockwise direction so that a knee 252 on the fixed end of the retainer bar 250 below or flush with a top surface of a platform 254. The pivot axis 256 is rigidly secured to the platform 254 along an axis generally parallel to the plane of the platform 254 in a rest position, as shown in FIG. 20.

The mattress retainer bar system illustrated in FIGS. 20-22 includes two retaining brackets 258 and 260. These brackets 258 and 260 hold the retainer bar 250 against the side of the platform 254 in a normal position, as shown in FIG. 20. These brackets 258 and 260 restrain movement of the retainer bar 250 in a direction parallel to the pivot axis 256 in a direction out of the page with respect to FIG. 20. The bracket 258 is located adjacent the pivot axis 256 and also acts as a stop to prevent counter-clockwise rotation beyond a normal position. The bracket 260 is located adjacent a free end of the retainer bar 250. The bracket 260 also acts as a stop and prevents clockwise rotation in a normal position.

With reference to FIG. 21, operation of the mattress retainer system is illustrated. In order to rotate the retainer bar 250, one leg 252 is bent slightly toward the pivot axis 256 to free the retainer bar 250 from the bracket 260. Once the retainer bar 250 is free from the bracket 260, the retainer bar 250 is rotated in a clockwise direction, as shown in FIG. 22 until the knee 252 of the retainer bar 250 is flush or below the plane of the top surface of the platform 254 defining an extended position.

Once the retainer bar 250 is in an extended position as shown in FIG. 22, the mattress (not shown) can be freely rotated with respect to the platform 254. Once the mattress is rotated to its desired position, the retainer bar 250 is rotated counter-clockwise and the leg 262 is latched with respect to the bracket 260 to return the retainer bar 250 to its normal position, as illustrated in FIG. 20. As mentioned above, the bracket 258 serves to stop counter-clockwise rotation of the retainer bar 250 once the retainer bar 250 is in a normal position, as illustrated in FIG. 20. The bracket 260 serves to stop clockwise and counter clockwise rotation of the retainer bar 250 once the retainer bar 250 is in a normal position, as illustrated in FIG. 20. Both brackets 258 and 260 hold the retainer bar 250 against the sides of the foundation or platform to hold the retainer bar 250 in an upright position to hold mattress in position relative to the foundation and keep it from sliding off of the foot of the bed.

Figure 23:
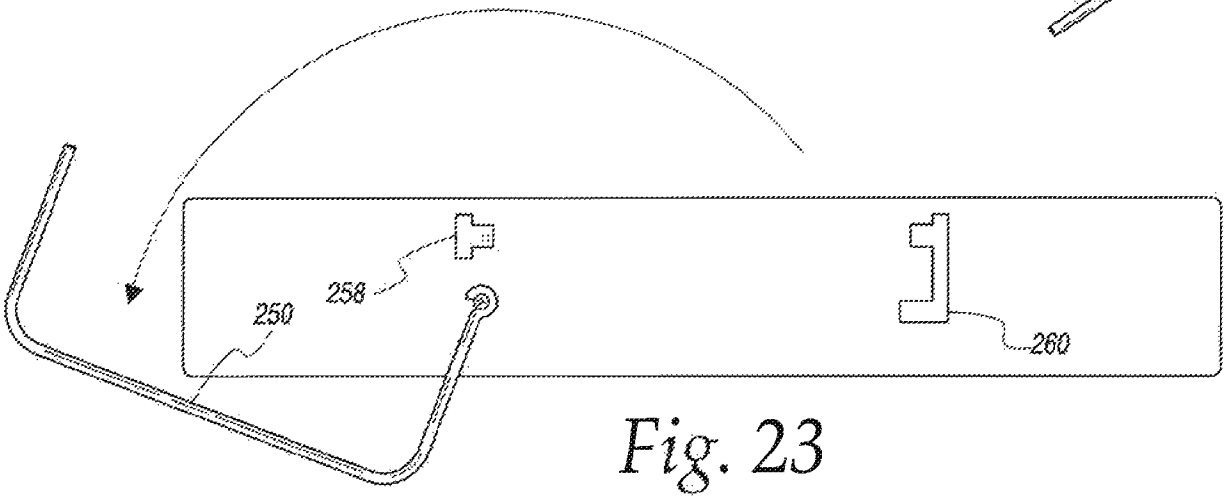
FIG. 23 illustrates an alternate embodiment of the mattress retainer system illustrated in FIG. 20, shown in an extended position.

FIG. 23 is an alternate embodiment of the mattress retainer system illustrated in FIGS. 20-22. In this embodiment, the direction of rotation from a normal position to an extended position is counter-clockwise, as shown. The bracket 260 is the same but the orientation of 258 is flipped as shown to allow counterclockwise rotation of the retainer bar 250.

Figure 24:
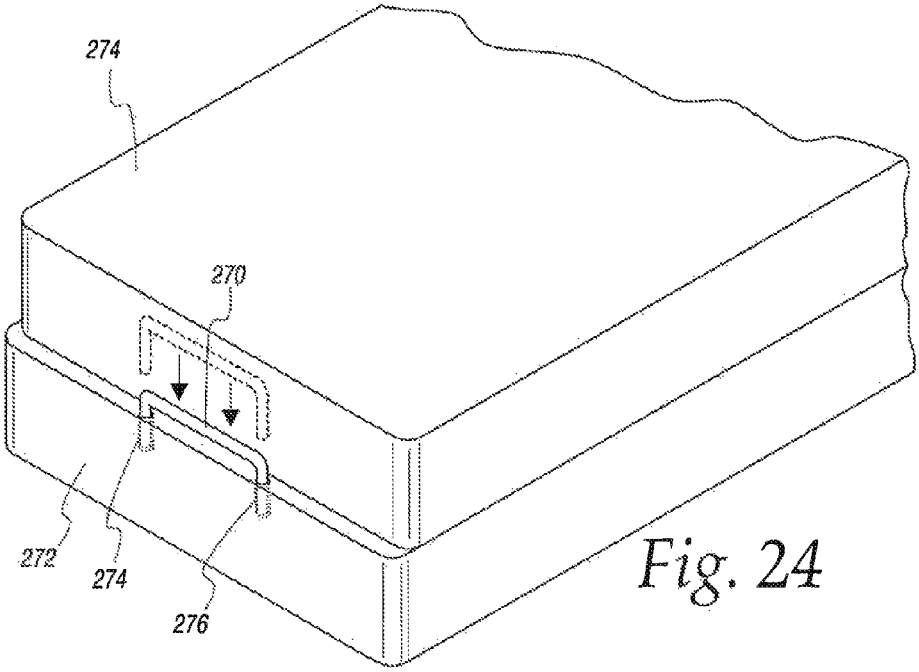
FIG. 24 is an isometric view illustrating an alternate embodiment of the retainer bar system that is movable in a direction generally perpendicular to the plane of the mattress, shown in a retracted position with the normal position shown in phantom.
Figure 25:
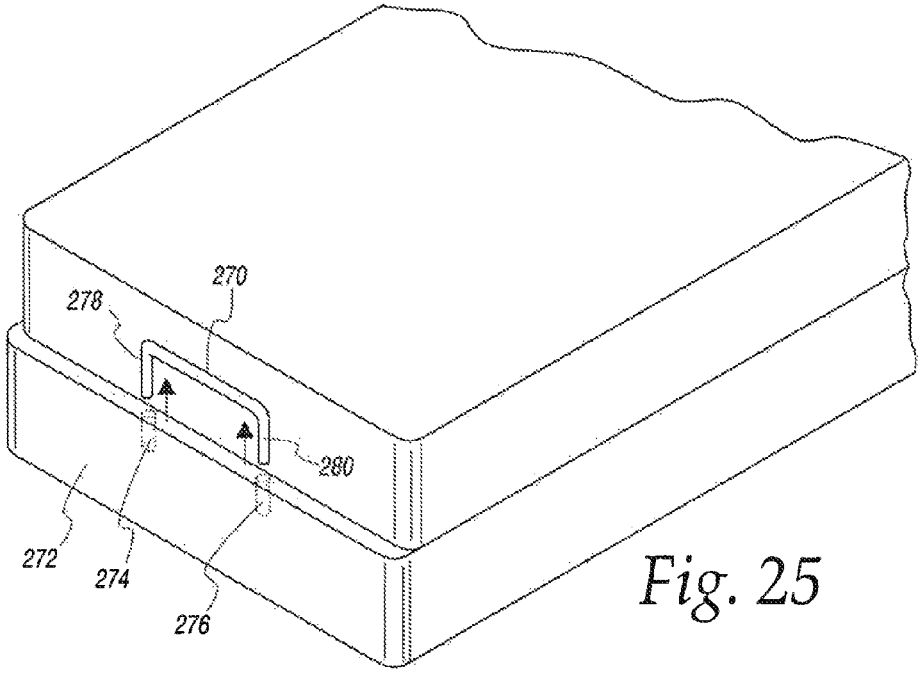
FIG. 25 is similar to FIG. 24 illustrating another alternate embodiment that is that is movable in a direction generally perpendicular to the plane of the mattress and removable, shown with the retainer bar removed.

In the embodiments illustrated in FIGS. 24-35, sleeves or bushings are concealed in the mattress panel 54. These sleeves are used to receive the free ends of the retainer bars. In the embodiments illustrated in FIGS. 24 and 25 and 30-35, vertical sleeves, generally parallel to outside vertical wall of the mattress panel 54 are mostly or completely concealed in the mattress platform panel 54 (FIG. 1). In the embodiments illustrated in FIGS. 24 and 25, the retainer bar system may be configured so that the retainer bar can be completely removed, as illustrated in FIG. 25 or pushed down out of the way so that the top of the retainer bar is below or flush with the underside of the mattress. In the latter embodiment, a notch parallel to the horizontal portion of the retainer may be formed in a top surface of the mattress panel 54 so that the horizontal bar is either flush or below the bottom surface of the panel. An exemplary latch mechanism, as illustrated in FIG. 36 may be used to secure retainer bar sleeves that are concealed by the mattress platform, as discussed below.

Referring to FIGS. 24 and 25, an alternate embodiment of the mattress retainer bar system in which a C-shaped retainer bar 270 is movably attached to one end of the mattress panel 272. In both embodiments, the retainer bar 270 is movable in a direction that is generally perpendicular to the plane of the mattress panel 272. In particular, wells or sleeves 274 and 276 are formed in the platform 272, as shown, and configured to receive the legs 278, 280 of the retainer bar 272. Alternatively, the wells 274 and 275 can be formed by tube shaped brackets attached to the side of the platform or foundation to receive the ends of the retainer bar 270. In the embodiment shown in FIG. 24, the retainer bar 274 is pushed downwardly to a retracted position to enable a mattress 274 to be rotated with respect to the platform 272. In the embodiment illustrated in FIG. 25, the retainer bar 270 is removable.

Figure 26:
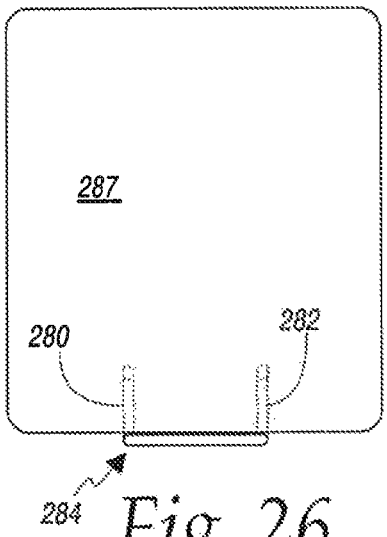
FIG. 26 is a top view of a mattress illustrating another alternate embodiment of the invention in which the retainer bar is movable in a direction parallel to the plane of the mattress.
Figure 27:
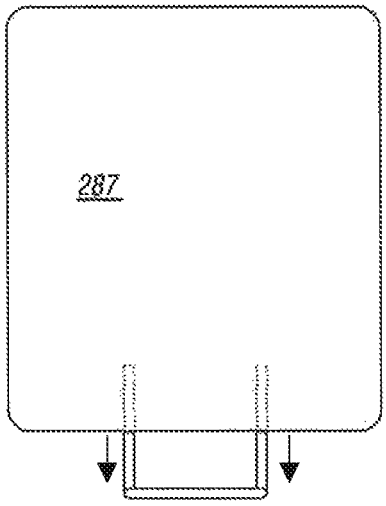
FIG. 27 is similar to FIG. 26 but shown in an extended position.
Figure 28:
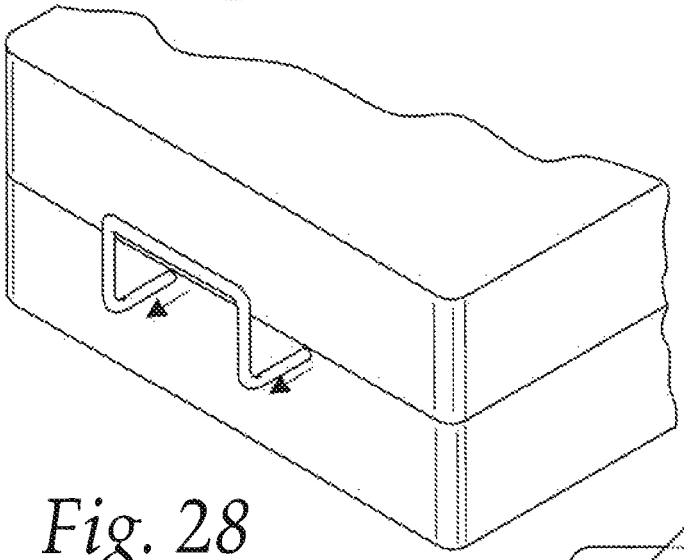
FIG. 28 is a partial isometric view of the embodiment illustrated in FIGS. 26 and 27, shown with the retainer bar in an extended position.
Figure 29:
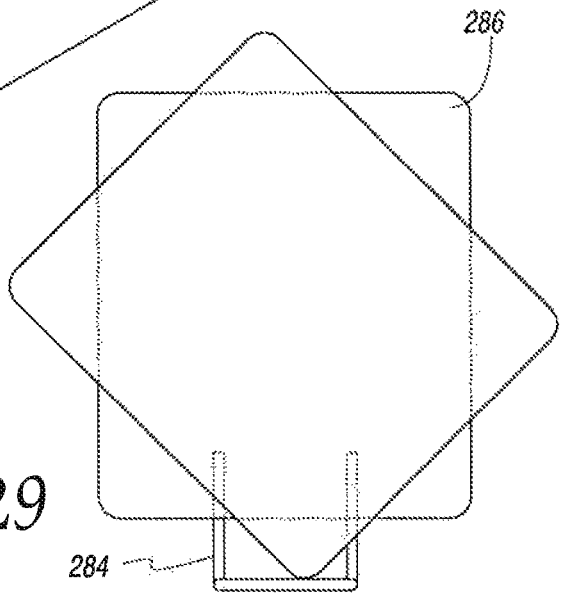
FIG. 29 is a top plan view of a mattress and foundation and the retainer system illustrated in FIGS. 26-28 shown with a mattress partially rotated with respect to the foundation.

Referring to FIGS. 26-29, an alternate embodiment of the retainer bar system is illustrated. In this embodiment, the sleeves in the mattress panel 54 are parallel to the plane of the mattress panel. In this embodiment, the retainer bar has a normal position, as shown in FIG. 26 and an extended position, as shown in FIG. 27. As shown in FIGS. 28 and 29, in the extended position, the retainer bar is extended far enough to allow the mattress to rotate.

FIGS. 26-28 are similar to FIGS. 24 and 25 except the wells 280 and 282 for receiving the retainer bar 284 are formed in the platform 286 (FIG. 29) in a direction parallel to the plane of the platform 286. Alternatively, the wells or sleeves can be formed by tube shaped brackets attached to the top of the platform or foundation to receive the ends of the retainer bar 270. In this embodiment, the retainer bar 284 is movable in a direction generally parallel to the direction of the plane of the platform 286. FIG. 26 illustrates a normal position while FIGS. 27-29 illustrate extended positions. Once the retainer bar 284 is extended, the mattress 287 can be rotated as shown in FIG. 29.

With reference to FIGS. 30-35, various configurations for mattress retainer bars suitable for the head and foot ends of the bed as well as corner bars. These mattress retainer bars can be categorized in two groups. One group which includes the embodiments illustrated in FIGS. 30, 31, 34 and 35 are suitable for use in active mattress rotation applications, for example, as set forth in U.S. Pat. Nos. 8,006,331; 8,246,706; 8,549; and 8,863,326; all hereby incorporated by reference. The other group which includes the embodiments illustrated in FIGS. 24, 25, 32 and 33 are suitable in passive mattress rotation systems, for example, as set forth in U.S. Pat. No. 8,510,880, hereby incorporated by reference.

With reference to 30 and 31, the active mattress retainer bar 300 includes a top horizontal bar 302 and parallel spaced apart legs 304 and 306 attached to the ends of the top horizontal bar 302. The legs 304 and 306 are generally perpendicular relationship with the top horizontal bar 302. A pair of supports 308 and 310 is attached to the free ends of the legs 304 and 306. The supports 308 and 310 are parallel to each other and perpendicular to the legs 304 and 306 and extend outwardly therefrom forming an "L" shape with the legs 304 and 306. Spaced apart parallel inserts 312 and 314 are attached to the free ends of the supports 308 and 310. The inserts 312 and 314 are generally parallel to the legs 304 and 306 and are generally perpendicular to the supports 308 and 310. The 312 and 314 are configured to be received in the sleeves or bushings 316 and 318 disposed in the mattress platform 54 generally perpendicular thereto.

Figure 30:
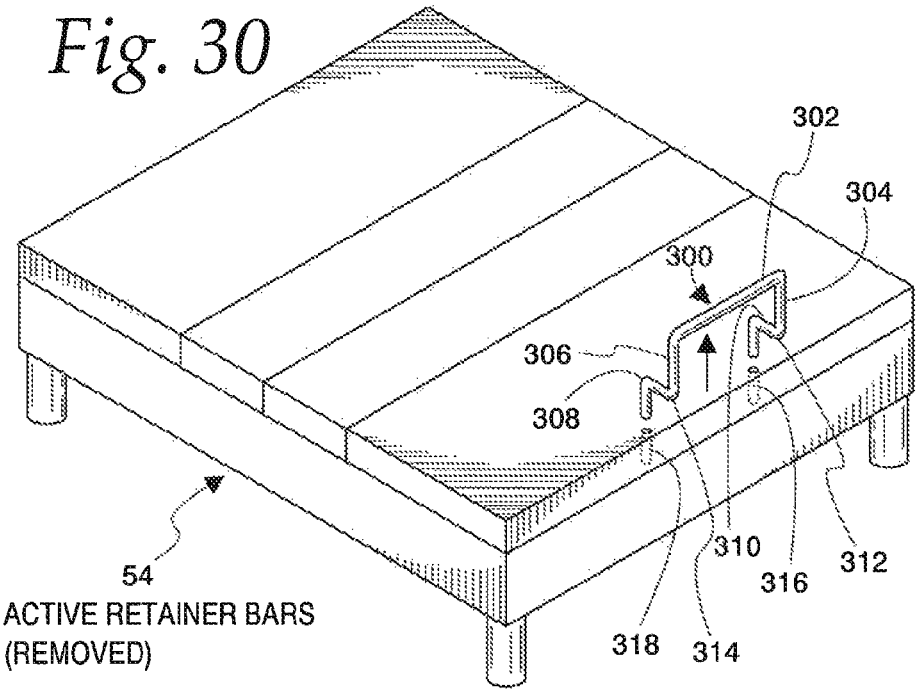
FIG. 30 is an isometric view of a mattress platform for an adjustable bed shown with one embodiment of a retainer bar in accordance with the present invention removed for use on head and/or foot ends of the mattress.
Figure 31:
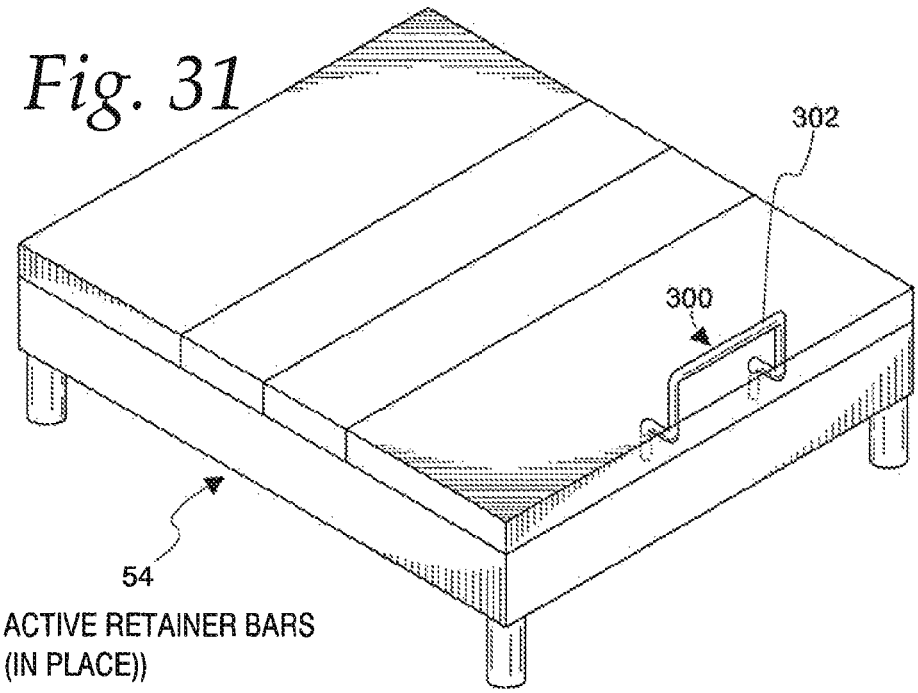
FIG. 31 is similar to FIG. 30 but shown with the retainer bar installed in the mattress platform.

In this embodiment the weight of the mattress (not shown) may be used to hold the mattress retainer bar 300 in place in a normal mode of operation. In particular, in these embodiments, the mattress rests on the supports 308, 310. When it is desired to rotate the mattress, the active mattress rotation system is activated to raise the mattress. Once the mattress is levitated, relieving the weight on the mattress retainer bar 300, the mattress retainer bar 300 can be removed, as shown in FIG. 30 in a rotate mode of operation, and the mattress rotated. Once the mattress is in the desired position, the mattress retainer bar 300 is re-installed, as shown in FIG. 31, while the mattress is still levitated in a normal mode of operation. Once the mattress retainer bar 300 is in place, the active mattress rotation system can be de-activated, allowing the mattress to be reseated on the mattress panel 54.

Figure 34:
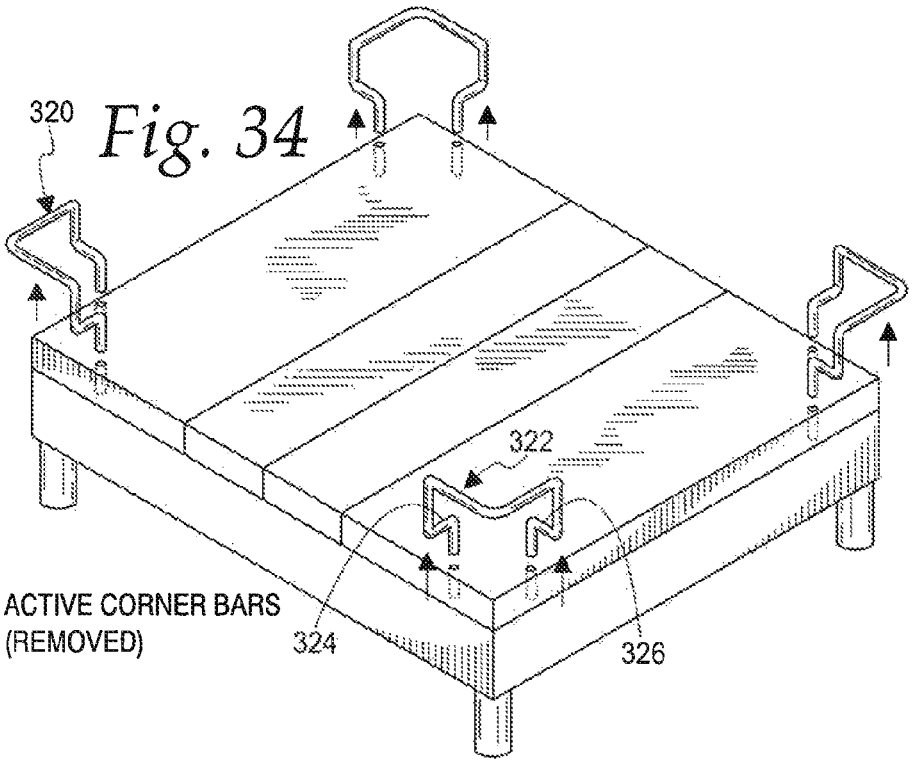
FIG. 34 is an isometric view of a mattress platform for an adjustable bed shown with an alternate embodiment of the corner retainer bars illustrated in FIGS. 32 and 33, shown with the retainer bars removed.
Figure 35:
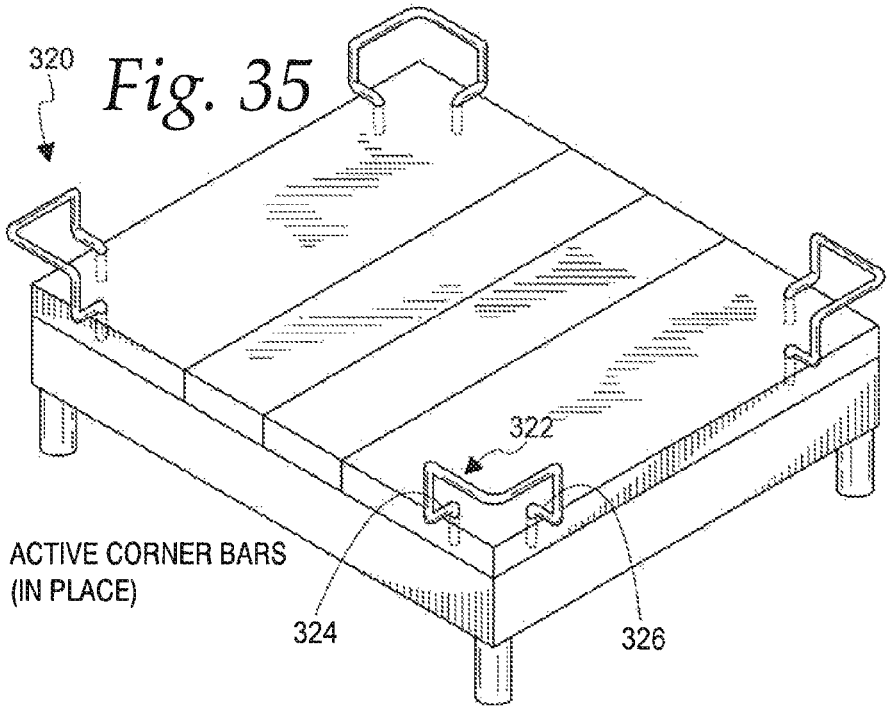
FIG. 35 is similar to FIG. 34 but shown with the corner retainer bars installed in the mattress platform.

FIGS. 34 and 35 illustrate active mattress retainer bars 320 for use on the corners. FIG. 34 illustrates a rotate mode of operation, while FIG. 35 illustrates a normal mode of operation. The corner mattress retainer bar 320 is similar to the mattress retainer bar 300 used on the head or foot end of a mattress platform 54. The only differences is that the top bar 322 and the supports 324 and 326 are angled, for example, at a 90° angle.

Figure 32:
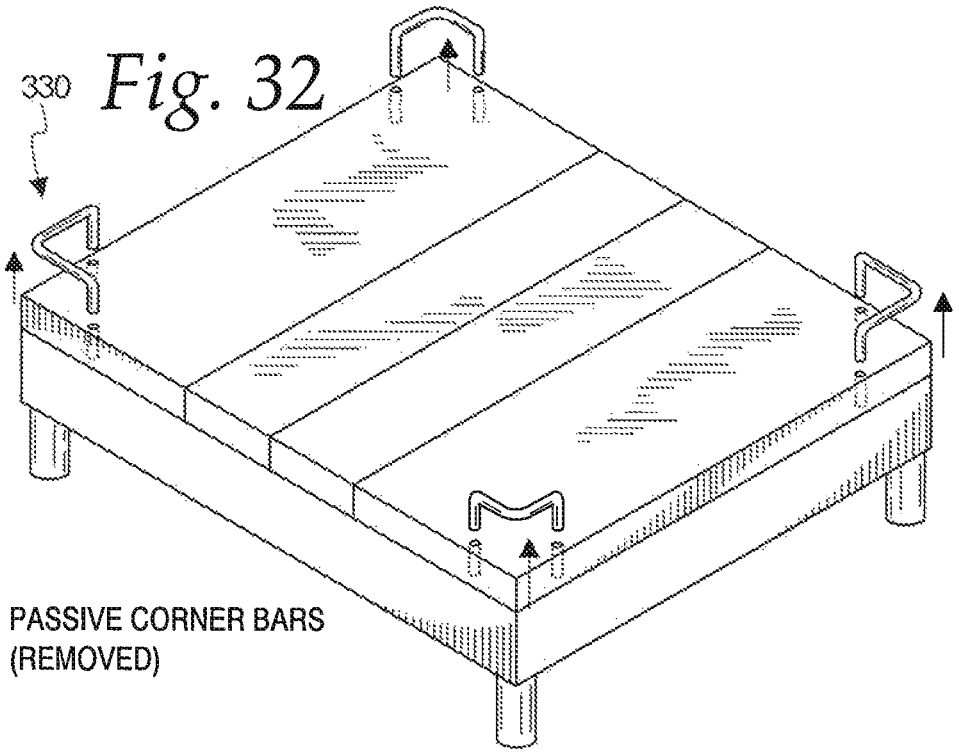
FIG. 32 is an isometric view of a mattress platform for an adjustable bed shown with retainer bars for use in the corners of a mattress in accordance with the present invention, shown with the retainer bars removed.
Figure 33:
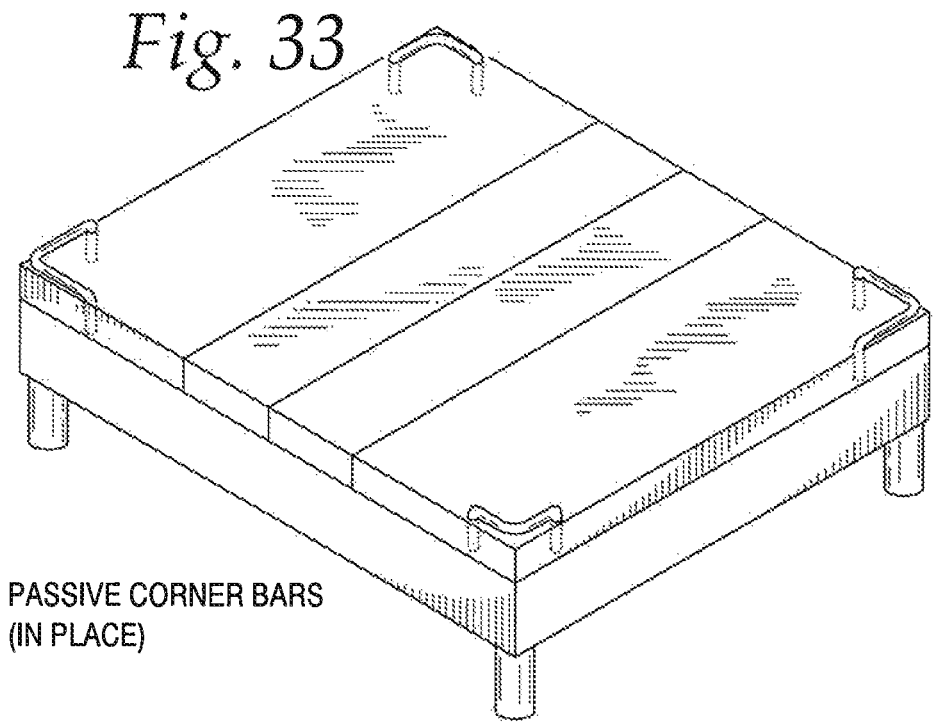
FIG. 33 is similar to FIG. 32 but shown with the retainer bars installed in the mattress platform.

It is to be noted that the sleeves 316 and 318 illustrated in FIGS. 30 and 31, as well as the sleeves illustrated in FIGS. 34 and 35, may be spaced relative to the edge of the mattress platform 54 so that the sides of the mattress will be in contact with the retainer bars 300 and 322. It is also contemplated that the sleeves can orientated to be generally parallel to the plane of the mattress platform 34. In such an embodiment, the inserts 312 and 314 are eliminated. The supports 308, 310 are received directly into the sleeves. The top of the mattress panel 54 may be notched to receive the sleeves and the supports The passive retainer bars 270 for use on a head or foot end of a bed, illustrated in FIGS. 24 and 25 are discussed above. The passive corner mattress retainer bars, generally identified with the reference numeral 330, are similar to the retainer bar 270 except that the top horizontal bar is angled at 90°. FIGS. 24 and 32 illustrate a rotate mode in which the retainer bars 270 and 330 are removed. FIGS. 25 and 33 illustrate a normal mode in which the mattress retainer bars are re-installed.

As illustrated in FIG. 19, once the removable mattress retainer bars are removed, the mattress can be rotated. Once the mattress is in the desired position, the mattress retainer bars can be re-installed. Alternatively, the mattress retainer bars can be pushed down. A notch may be formed in the mattress platform so that the retainer bar is either flush or below the underside of the mattress. The embodiments illustrated in FIGS. 15, 16, 20-23 and 26-28 allow the mattress retainer bar to be positioned in a rotate mode. In these embodiments, the retainer bars are positioned so as not to interfere with the rotation of the mattress. The mattress is then rotated, for example, as illustrated in FIGS. 19 and 29. Once the mattress is in the desired position, the mattress retainer bars can be re-positioned to a normal mode, for example, as illustrated in FIGS. 15, 20 and 26.

In addition to rotation of a mattress, once the mattress retainer bars are removed or otherwise positioned below or flush with the surface of the bottom of the mattress, the mattress can be slid off of the mattress platform assembly to install or launder or change a bed skirt or protective mattress encasement, for example as illustrated in US Patent Application for a Passive Mattress Management System, Publication No. US 2013/02012,809 A1 and US Patent Application for a Four in One Mattress Management System, Publication No. US 2013/0269,108 A1, hereby incorporated by reference. Once the bed skirt is installed, the mattress can be re-installed and the retainer bars extended or positioned to the extended or normal positions that prevent movement of the mattress relative to the platform.

FIGS. 5 and 36 illustrate exemplary latch assemblies for all of the embodiments in which the retainer bars are removable. The latch 128, illustrated in FIG. 5, is suitable for applications in which the sleeve for receiving the retainer bar is accessible, for example, as illustrated in FIG. 4. A suitable latch 128 is a single button latch-type snap button, available, for example, from Valco Valley Tool & Die, Inc. (valcocleve.com/). Other latch mechanisms are contemplated.

In this application, a through hole is provided in the outer sleeve 108. A spring loaded button 132 is received in a through hole formed in each of the legs 122 and 124 of the retainer bar 120. During insertion, the buttons 136 are depressed as the legs 122 and 124 are inserted into the outer sleeves 108. The buttons 132 are held in by the inner wall of the sleeve 108. When the legs 122 and 124 are pushed down far enough so that the buttons 132 are at the level of the through hole of the outer sleeve, the buttons 132 pop out under the influence of the biasing spring 130 to latch the legs 122 and 124 in place. In order to remove the retainer bar 120, the buttons 132 are depressed and the retainer bar 126 is removed.

FIG. 36 illustrates an embodiment of a latch 350 that can be used in all embodiments in which the outer sleeve is within the mattress platform and is therefore not accessible, for example, as illustrated in FIGS. 24 and 26. The latch 350 can also be used in embodiments in which the outer sleeve is disposed, for example, in a groove, on the top of the mattress platform 54 (FIG. 1).

The latch 350 is a dual button latch type snap button. Such latches are available from Valco Valley Tool & Die, Inc. Other latch mechanisms are also suitable. As will be described in more detail below, one button is used for latching and the other button is used to release the latch.

As shown, an outer sleeve 352 is shown below the surface of the mattress platform 54 (FIG. 1). A leg 356 is of the retainer bar is shown within the sleeve 352. The leg 356 includes a through hole for receiving a first button 358. As shown, when the leg 356 is fully inserted within the outer sleeve 352, the first button is below the surface 354 of the mattress platform 54 and is received in a through hole 360 in the outer sleeve 352 to latch the leg 356 in place. A second button 362 axially spaced above the first button 358 above the surface of the mattress platform 54 is received in a through hole in the leg 356 to receive the button 362.

The first button 360 is used for latching and the second button 362 releases the latch. In operation, the second button 362 is depressed which under the influence of the spring force causes the first button 358 to be retracted. The leg 356 is then inserted into the outer sleeve 352. When the first button 358 comes in contact with the outer sleeve, 352, the second button 362 is released. Once the first button 358 is at the level of the through hole 360 in the outer sleeve 352, the first button 358 pops out and is received in the through hole 358 in the outer sleeve 352 to latch the leg 356 in place.

In order to remove the retainer bar, the second button 362, which will be above the surface of the mattress platform, is depressed. This causes the first button 358 to be retracted under the influence of the spring force to enable the retainer bar to be removed. The retainer bar can then be removed.

FIGS. 37-39 illustrate exemplary embodiments of a motorized version of retainer bar. The embodiment illustrated in FIGS. 37 and 38 is illustrated in connection with horizontal movement of a head and foot retainer bar, as illustrated in FIGS. 26 and 27. It is also contemplated that the motorized version can be configured for use with horizontal movement of corner retainer bars. As shown in FIG. 39, the motorized version can also be used for vertical movement for both head/foot and corner retainer bars, as illustrated by the corner retainer bar 406.

In the embodiment illustrated in FIGS. 37 and 38, the retainer bar 380 is attached or integrally formed with a carriage 382. Other carriers for the retainer bar are also contemplated. The carriage 32 is slidingly received in a pair of spaced apart rails or brackets. 384. These brackets 384 may be secured to an underside of the mattress platform 54 (FIG. 1) to enable the retainer bars to be placed in a retracted position, as shown, for example, in FIG. 26 and an extended position, as shown in FIG. 27.

This embodiment also includes a motor 336 and a mechanical mechanism 388 for translating the rotary motion of a motor shaft to horizontal motion for automatically extending and retracting the retainer bars. Various mechanical mechanisms 388 are contemplated. A rack and pinion mechanical mechanism is illustrated. However, virtually any mechanical mechanisms for translating the rotary motion of a motor shaft to linear motion can be used, such as a rotary screw drive or worm drive.

The motor 336 may be a stepper motor. As is known in the art, such stepper motors in combination with a encoding disk enable the stepper motor to be programmed for a predetermined amount of the retainer. Specifically, with reference to FIGS. 26 and 27, the stepper motor can be programmed to extend the retainer bar as illustrated in FIG. 27 and retract the retainer bar, as shown in FIG. 26. Such programming of a stepper motor is well within the ordinary skill in the art. Motors other than stepper motors are also contemplated.

The stepper motor is typically connected to a control box 390 that is connected to an external source of electrical power 392. The control box 390 may be configured to allow the stepper motor to be controlled by way of a wireless remote control. Such control boxes are well within the ordinary skill in the art.

In operation, when it is desired to rotate a mattress, the stepper motor 386 is controlled to extend the retainer bar, as illustrated in FIG. 27. The mattress is then rotated, as illustrated, for example in FIG. 19. Once the mattress is in the desired position, the stepper motor 386 is controlled to retract the retainer bar, for example, as illustrated in FIG. 26.

An alternate embodiment of the motorized retainer bar is illustrated in FIG. 39. This embodiment is similar to the embodiment illustrated in FIGS. 37 and 38. In this embodiment the carriage is eliminated and the mechanical mechanism 400 is formed on or attached to the free ends of the legs of the retainer bar 402. In this embodiment, a rack and pinion mechanical mechanism is shown. However, other types of mechanical mechanisms are contemplated, as discussed above. The legs of the retainer bar 402 may be secured to the underside of the mattress platform 54 by way of one or more brackets 404. As shown, the motorized version can be used with head and foot retainer bars 402 as well as corner retainer bars 406.

An alternate configuration of a retainer bar is illustrated in FIG. 40. In this embodiment, the retainer bar 410. The retainer bar 410 is configured for use with fitted sheets. The retainer bar is formed with a generally "L" shaped configuration defining a vertical leg 412 and a horizontal leg 414. As shown, the vertical leg 412 is formed with an indentation 416. The indentation 416 is configured to be disposed adjacent the bottom of the mattress 418. As such, the free edge of the fitted sheet is received in the indentation. As shown, the horizontal leg 414 can be secured to an underside of the mattress platform 420.

FIGS. 41A-41C illustrate yet another alternate embodiment of a retainer bar system. In this embodiment, a generally "L" shaped retainer bar. The retainer bar 430 includes a horizontal leg 432 and a vertical leg 434. The vertical leg 434 is secured to a vertical wall of a mattress platform or foundation 436. The horizontal leg 432 is disposed to be parallel to the top of the mattress platform 436. The horizontal leg 432 is slightly spaced above the mattress platform 436, for example by ⅛-½ inch and otherwise configured to catch a pocket 438 formed in an underside of a mattress encasement 440.

Obviously, many modifications and variations of the invention are possible in light of the above teachings. All such configurations are intended to be within the broad scope of the invention. Thus, it is to be understood that, within the scope of the appended claims, the invention may be practiced otherwise than as specifically described above.

I claim:

1. A mattress retainer assembly for selectively constraining rotational movement of a mattress, said mattress retainer assembly comprising:

a bracket formed to be securely attached to a bed frame, said bracket further formed to receive a mattress retainer bar and allow for movement of said mattress retainer bar in a linear direction;

the mattress retainer bar, movably mounted relative to said bracket in a linear direction with respect to said bracket, said mattress retainer bar movable between an extended position in which movement of a mattress relative to said bracket is constrained by said mattress retainer bar and a retracted position in which movement of the mattress is not constrained by said mattress retainer bar; and a detent mechanism for latching said mattress retainer bar in said extended position.

2. The mattress retainer assembly as recited in claim 1, wherein said mattress retainer bar is movably mounted in a direction generally perpendicular to a sleeping surface of said mattress.

3. The mattress retainer assembly as recited in claim 1, wherein said bracket is formed to be securely attached to a bed frame that is formed as an adjustable platform.

4. The mattress retainer assembly as recited in claim 1, wherein said bracket and said mattress retainer bar are formed to be disposed adjacent a flat side panel of said mattress.

5. The mattress retainer assembly as recited in claim 1, wherein said bracket and said mattress retainer bar are formed in an "L" shape so as to be able to be disposed adjacent a corner of a mattress.

6. The mattress retainer assembly as recited in claim 1, wherein said mattress retainer bar is "C" shaped.

7. The mattress retainer assembly as recited in claim 1, wherein said mattress retainer bar is not "C" shaped.

8. The mattress retainer assembly as recited in claim 1, wherein said mattress retainer bar includes a first pair of spaced apart parallel legs connected together with a bar and further includes a pair of spaced apart supports connected on end to said first pair of spaced apart legs and further includes a pair of spaced apart parallel inserts connected on end to said spaced apart supports.

9. The mattress retainer assembly as recited in claim 8, wherein said mattress retainer bar is formed to be attached to a flat surface of said mattress.

10. The mattress retainer assembly as recited in claim 8, wherein said mattress retainer bar is formed to be attached across a corner of a side panel of said mattress.

11. A mattress retainer system for preventing unintended rotation of a mattress with respect to an adjustable platform; the mattress retainer system comprising:

a mattress retainer bar having a pair of spaced apart "L" shaped legs connected together on one end by a bar, said "L" shaped legs each having a vertical leg and a horizontal leg, wherein said vertical legs are formed to be secured to a vertical surface of said platform and horizontal legs and said bar are formed to lie generally parallel to a flat surface of said adjustable platform; and an encasement for encasing said mattress, said encasement formed with a complementary member for engaging the mattress retainer bar to prevent rotation of the mattress with respect to said platform.

12. The mattress retainer system as recited in claim 11 wherein said complementary member includes a second mattress retainer bar attached to an underside of the encasement for engaging said mattress retainer secured to said foundation when said mattress is aligned with said platform.

13. The mattress retainer system as recited in claim 11 wherein said complementary member includes a pocket attached to an underside of the encasement for engaging said mattress retainer secured to said foundation when said mattress is aligned with said platform.

14. A mattress retainer assembly for selectively constraining rotational movement of a mattress, the mattress retainer assembly comprising:

a carriage formed to be securely attached to a bed frame for carrying a mattress retainer bar;

a mattress retainer bar for selectively constraining a mattress from rotating, said mattress retainer bar selectively movably mounted with respect to said bracket between a retracted position and an extended position;

a mechanical mechanism attached to said mattress retainer bar for translating rotational movement of a motor shaft to linear motion, said mechanical mechanism formed to move said mattress retainer bar between said retracted position and said extended position;

a motor attached to said mechanical mechanism; and a control box for selectively powering said motor.

15. The mattress retainer assembly as recited in claim 14, wherein said mechanical mechanism is a rack and pinion.

16. The mattress retainer assembly as recited in claim 14, wherein said motor is a stepper motor.

17. A retainer bar for a fitted sheet used on a platform, the retainer bar comprising:

an "L" shaped retainer bar having a horizontal leg and a vertical leg, said retainer bar formed to be attached to an underside of said platform; and an indention formed in said vertical leg for receiving a free end of the fitted sheet.

18. A mattress retainer assembly for selectively constraining rotational movement of a mattress, the mattress retainer assembly comprising:

a bracket formed to be securely attached to a bed frame, said bracket formed to receive a mattress retainer bar;

the mattress retainer bar, movably mounted relative to said bracket for selective rotational movement with respect to said bracket about an axis generally parallel to a sleep surface of the mattress, said mattress retainer bar movable between a retracted position in which movement of a mattress relative to said bracket is constrained by said mattress retainer bar and an extended position in which movement of the mattress is not constrained by said mattress retainer bar; and a detent mechanism for latching said mattress retainer bar in said extended position.

19. The mattress retainer assembly as recited in claim 18, wherein said axis is generally parallel to a transverse axis of said mattress.

20. A mattress retainer assembly for selectively constraining rotational movement of a mattress, the mattress retainer assembly comprising:

the mattress retainer bar, formed to be rotationally mounted relative to a bed frame about an axis generally parallel to a longitudinal axis of the mattress, said mattress retainer bar movable between a retracted position in which movement of a mattress relative to said bracket is constrained by said mattress retainer bar and an extended position in which movement of the mattress is not constrained by said mattress retainer bar; and a bracket formed to be securely attached to said bed frame for restraining rotation of said mattress retainer bar in said retracted position.

* * * * *